US005875859A

United States Patent [19]

Ikeda et al.

[11] Patent Number: 5,875,859

[45] Date of Patent: Mar. 2, 1999

[54] DEVICE FOR CONTROLLING THE DRILLING DIRECTION OF DRILL BIT

[75] Inventors: Akio Ikeda, Hyogo; Koetsu Shano, Nara, both of Japan

[73] Assignee: Japan National Oil Corporation, Tokyo, Japan

[21] Appl. No.: 750,138

[22] PCT Filed: Jan. 31, 1996

[86] PCT No.: PCT/JP96/00187

§ 371 Date: Jan. 31, 1997

§ 102(e) Date: Jan. 31, 1997

[87] PCT Pub. No.: WO96/30616

PCT Pub. Date: Oct. 3, 1996

[30] Foreign Application Priority Data

| | | | |
|---|---|---|---|
| Mar. 28, 1995 | [JP] | Japan | 7-096006 |
| Mar. 28, 1995 | [JP] | Japan | 7-096007 |
| Mar. 28, 1995 | [JP] | Japan | 7-096008 |
| Mar. 28, 1995 | [JP] | Japan | 7-096009 |
| Mar. 28, 1995 | [JP] | Japan | 7-096010 |
| Mar. 28, 1995 | [JP] | Japan | 7-096011 |

[51] Int. Cl.[6] ..... E21B 7/04

[52] U.S. Cl. ..... 175/73; 175/74; 175/256

[58] Field of Search ..... 175/45, 61, 73, 175/80, 82, 83, 256

[56] References Cited

U.S. PATENT DOCUMENTS

| | | | |
|---|---|---|---|
| 4,811,798 | 3/1989 | Falqout, Sr. et al. | 175/73 |
| 5,259,467 | 11/1993 | Schoeffler | 175/73 X |
| 5,421,420 | 6/1995 | Malone et al. | 175/61 |
| 5,603,386 | 2/1997 | Webster | 175/45 X |
| 5,669,457 | 9/1997 | Sebastian et al. | 175/73 |

FOREIGN PATENT DOCUMENTS

| | | |
|---|---|---|
| 0577845 | 8/1993 | European Pat. Off. . |

*Primary Examiner*—Frank S. Tsay

*Attorney, Agent, or Firm*—Watson Cole Grindle Watson, P.L.L.C.

[57] ABSTRACT

A device for controlling the drilling direction of drills includes a cylinder-type housing 6, a first ring-formed component 11 which is located on an inner peripheral surface that is eccentric with respect to the cylinder-type housing 6, a second ring-formed component 12 which is located on the inner peripheral surface that is eccentric with respect to the circular inner surface of the first ring-formed component 11, and hollow-type harmonized reduction gears 13,14 which rotate the first and second ring-formed components 11,12 relatively around their respective centers. A resolver is positioned between the first and second ring-formed components 11,12 and the hollow-type harmonized reduction gears 13,14 to detect the rotating angular position of the first and second ring-formed components 11,12. A fulcrum bearing 8 of the rotating shaft 2 is located at a midpoint between the drill bit and the first and second ring formed components 11,12. A flexible joint 3 is located at the upper portion of the first and second ring-formed components 11,12 and a bearing 15 is further mounted on the flexible joint in order to support the rotating shaft 1.

6 Claims, 15 Drawing Sheets

DEVICE FOR CONTROLLING THE DRILLING DIRECTION OF DRILL BIT

TECHNICAL FIELD

The present invention is generally directed to a controlling device and constituent components thereof to control the drilling direction of a drill bit which is typically employed for oil and gas wells.

BACKGROUND ART

A drilling device is, in general, employed for the purposes of drilling holes to collect underground resources or for civil engineering construction. In particular, a rotary type drilling device is a typical type thereof to drill efficiently a well conduit which is located at an extensive depth to a certain level of the stratum, to collect underground liquid resources including petroleum, natural gas, or geothermal vapor. For the aforementioned type of drilling device, it is indispensable to adapt the controlling device to be equipped at the distal end portion of said drilling device to control the moving direction of the drill bit so that the drilling bit can deviate when it faces a hard rock plate, resulting in the drilling operation proceeding efficiently without any undesired interruption. Furthermore, in a case when the drilling direction misses its aiming direction due to unexpected causes, it is also necessary to employ a controlling device at the distal end portion of the drilling device to correct the drilling direction to the original target direction.

Conventionally, several controlling mechanisms which are adapted to the rotary type drill bit have been proposed to correct the drilling direction, including those disclosed in Japan Patent Application Laid-Open No. Sho 57-21695, Japan Patent Application Laid-Open No. Sho 57-100290 and Japan Patent Application Laid-Open No. Sho 58-210300. However, the controlling mechanism disclosed in any one of the aforementioned patents is unable to control the drilling direction in all directions. Moreover, the controlling mechanism in said prior arts was complicated. These are disadvantages associated with the conventional types of devices for controlling the drilling direction.

Recently, another controlling, mechanism has been proposed in a disclosure of the Japan Patent. Application Laid-Open No. Hei 4-76183. The proposed mechanism consists principally of a plurality of the hollow-type harmonized reduction gear, a plurality of the eccentric rotating component equipped with an eccentric hollow portion which is connected to respective outputs of said hollow-type harmonized reduction gear and rotates in an eccentric manner with respect to a rotating shaft of each reduction gear, and a rotating shaft for the drill bit which is equipped at the drilling device in such a manner that said drill bit is inserted through the hollow portion of said hollow-type harmonized reduction gear and the eccentric hollow portion of the eccentric rotating component. The above structures enable the rotating shaft to change direction and location approximately along the direction of a central axial line of the shaft due to a restricting action of the inner peripheral surface of the eccentrically rotating eccentric hollow portion.

Furthermore, yet another controlling mechanism (Japan Patent Application Laid-Open No. Hei 5-149079) has been proposed. The proposed controlling mechanism comprises (1) first and second hollow-type harmonized reduction gears which are provided co-axially to each other, (2) a first ring-formed component which is located in a co-axial manner with respect to said first hollow-type harmonized reduction gear and rotates by said reduction gear, and (3) a second ring-formed component which is coaxially located with respect to said second hollow-type harmonized reduction gear and rotates by said reduction gear. Ring-formed end portions of said first and second ring-formed components overlap each other to intake a relative rotation possible. The end region of the thus overlapped portion is defined at the slant surface which is inclined with a certain angle. A rotating shaft for the drilling bit is inserted through a hollow portion of said first and second ring-formed components. By rotating relatively these first and second ring-formed components, a deflection can be provided along a certain direction on the rotating shaft.

Moreover, still another controlling mechanism has been proposed in Japan Patent Application Laid-Open No. Hei 5-202689, as seen in FIG. 16, which consists of (1) a cylinder-type housing 601, (2) a first ring-formed component 602 which is rotatably supported on a circular inner peripheral surface of the cylinder-type housing 601 and is provided with a circular inner peripheral surface which is eccentric with respect to said cylinder-type housing 601, (3) a second ring-formed component 603 which is rotatably supported on a circular inner peripheral surface of the first ring-formed component 602 and is provided with a circular inner peripheral surface which is eccentric with respect to said circular inner peripheral surface, and (4) hollow-type harmonized reduction gears 604,605 which rotate the aforementioned first and second ring-formed components 602, 603 along their central axes. Having with the above structures, an amount of the eccentricity of the circular inner peripheral surface of the first ring-formed component 602 with respect to the cylinder-type housing 601 is set to be equal to the amount of the eccentricity of the circular inner peripheral surface of the second ring-formed component 603 with respect to the first ring-formed component 602. A rotating shaft 607 having a drill bit 606 at its distal end portion is connected to the second ring-formed component 603 in order to move along with a center portion of the circular inner peripheral surface of the second ring-formed component 603. Moreover, the rotating shaft 607 can be positioned with respect to a fulcrum bearing 608 as a fulcrum point by rotating, respectively, the first and second ring-formed components 602,603.

With all of the aforementioned controlling devices for the drilling direction of drill bits, since the fulcrum point of the deflection of the rotating shaft is located at the upper supporting mechanism for the shaft of the controlling device for the drill bit, there is a risk of fracture due to an excess bending stress which would be caused by the deflection provided at the rotating shaft.

In the above drills, if the deflection, which is subjected to the rotating shaft when the drill direction is deviated, is absorbed by providing a universal joint at the location at which the maximum bending stress takes place on the rotating shaft, then the damage on the rotating shaft due to the excess bending stress can be prevented.

Furthermore, it is necessary to protect the device for controlling the drilling direction from high temperature and high pressure hostile environment, since the drills are normally utilized in the area close to the bottom of oil or gas well conduits. Moreover, the lubricant oil, which is filled and sealed in a ring-shaped space defined with the cylinder-type housing being provided on the outer peripheral surface of the rotating shaft, is required to be sealed in a water-proof manner by sealing materials which are mounted at both ends of said cylinder-type housing.

With the conventional types of drills, the lubricant oil is filled and sealed inside the cylinder-type housings at ambient pressure and temperature on the ground level. When the drills are used in the bottom portion of well conduits, the lubricant oil will be indirectly exposed to high temperature and pressure. Hence, changes in pressure due to volume expansion will take place. Under these circumstances, if the pressure difference with the pressure of the surrounding muddy water exceeds the threshold pressure difference at seals which are located at both ends of the cylinder-type housings, the lubricant oil will leak out, or the muddy water will leak in. These might cause the controlling device to be inoperative.

Conventionally, a double seal mechanism has been employed as a sealing device between the cylinder-type housing and the rotating shaft, as seen in FIGS. 4*a* and 4*f*, disclosed in Japan Patent Application Laid-Open No. Sho 57-21695 (US 6/158948).

Although the direction and magnitude of the deflection to which the rotating shaft is subjected can be determined by the position of the rotating angles of the first and second circular components in the aforementioned types of devices for controlling the drilling direction, such a detecting mechanism was not described in said Japan Patent Application Laid-Open No. Hei 5-202689. Furthermore, said Japan Patent Application Laid-Open No. Hei 5-202689 employed a pulse-counting method (normally using a photo sensor or an eddy current sensor) by which, as seen in FIG. 17(*a*), a gear 702 is provided at the surface of the rotating body 701; and pulses, shown in FIG. 17(*b*), which detect the number of gears passing through during the rotation, are counted by using a sensor 703.

In summary, the devices for controlling the drilling direction described in Japan Patent Application Laid-Open No. Hei 4-76183, Japan Patent Application Laid-Open No. Hei 5-149079 and Japan Patent Application Laid-Open No. Hei 5-202689 exhibit the following technical problems.

(A) The thrust bearing, which bears the bit load, functions as a supporting mechanism for an upper rotating shaft of the device for controlling the drilling direction, and the bit load acts up to this location of the rotating shaft.

(B) Although the direction and magnitude of the deflection of the rotating shaft can be determined by knowing the rotating angular position of the first and second ring-formed components, it is difficult to maintain the original reference point for detecting the rotating angular position if a conventional type of pulse-counting method (normally using a photo sensor or an eddy current sensor) is employed. Moreover, it is more difficult to detect the rotating angular position with a satisfactory accuracy under the hostile environment at the bottom portion of the well conduits where the high temperature and pressure exist several hundreds or thousands of meters underneath the ground surface, although it could be achieved by adjusting the measuring accuracy on the ground.

(C) The fulcrum of the deflection of the rotating shaft functions as a supporting mechanism for the upper shaft of the device for controlling the drilling direction, resulting in the distance from the fulcrum to lower sealing mechanism becoming longer, and the magnitude of the eccentricity of the shaft at the lower sealing portion will become larger when the rotating shaft deflects. Accordingly, the structure of the sealing mechanism will become more complicated and the design for the sealing mechanism will become more difficult. Furthermore, the bending angle of the rotating shaft can not be made large due to the restriction from the sealing mechanism per se.

(D) The double eccentric mechanism supports the rotating shaft right above the drill bit. Hence the vibration during the drilling operation will transfer directly and instantaneously to the eccentric mechanism. This might cause a problem with regard to the structural integrity.

As a result, since the conventional type of controlling device controls the drilling direction by using the lateral load of the drill bit, then the quantity of lateral load of the drill bit will be extensively altered by the changes in the bit load due to the weak rigidity of the rotating shaft. In the worst case, the drill bit might turn to the opposite direction from the desired direction. This is an another major disadvantage associated with the conventional types.

Furthermore, the universal joint, which is utilized in the conventional type of devices for controlling the drilling direction, connects two eccentric driving shafts that are employed for driving the rotating machines and transfers only the rotating force. Unfortunately, any type of universal joint which can be utilized in locations where a fluid is flowing inside such drill pipes is not yet known.

Moreover, the double ring seals, which are located between the cylinder-type housing and the rotating shaft in the conventional type of devices for controlling the drilling direction, can not only respond to the changes in pressure of the lubricant oil which is filled and sealed between cylinder-type housing and the rotating shaft in the device for controlling the drilling direction of the drills, but also can not follow the changes in displacement along a direction perpendicular to the shaft axis of the rotating shaft when the drilling direction is required to change. Furthermore, the aforementioned type of sealing mechanisms exhibits a lower endurance due to the sliding movement of the displacement along the direction perpendicular to the shaft axis and the leaking-out of the lubricant oil and leaking-in of the muddy water can not be prevented.

Furthermore, the pulse-counting method to detect the position of the rotating angle of the first and second ring-formed components which are equipped in the device for controlling the drilling direction possesses the following technical drawbacks.

(a) It can only detect the position if the distance between the detecting sensor and the object is within several millimeters. In particular, the photo sensor is prone to be degraded due to the contaminated lubricant oil, resulting in a malfunction or a disability of the detection.

(b) An additional sensor, which is exclusively used for detecting the original reference point for the controlling purpose, is needed, causing a more complicated program for the angle detection.

(c) Although it is easy to control the original reference point on the ground level, it will become difficult to maintain said original reference point and nearly impossible to perform a satisfactorily accurate detection under the high temperature and pressure several hundreds or thousands of meters underneath the ground surface.

(d) Since the eddy current sensor is susceptible to being influenced by the noises due to the high frequency signals, it will be nearly impossible to conduct a accurate detection satisfactorily for cases of oil drilling operations by which the cable length between the sensor and the controlling unit could be on the order of several hundreds or thousands of meters under the ground level.

All of the foregoing have resulted in a requirement for the device of the present invention whose primary objective is to provide a device for controlling the drilling direction of the drill by which the positions of the rotating angles of the first and second ring-formed components can be detected with a satisfactory accuracy at the bottom portion of well conduits under high temperature and pressure. This means that (i) the magnitude of the displacement along the direction perpendicular to the axial direction of the rotating shaft at the lower sealing portion can be minimized, (ii) the adverse action of the bit load and vibration during the drilling operation on the eccentric mechanism portion—which is a relatively weak structure—can be controlled, (iii) and the rigidity of the rotating shaft above the drill bit can be enhanced.

The second objective of the present invention is to provide a hollow universal joint for drills by which the deflection generated at the rotating shaft can be released by said device for controlling the drilling direction, and the flowing-out of the muddy water, which is flowing inside the rotating shaft, can be prevented.

The third objective of the present invention is to provide pressure-equalizing equipment and sealing equipment for the device for controlling the drilling direction, by which leaking-out of the lubricant oil which has been filled and sealed in the said controlling device and leaking-in of the muddy water can be prevented for a long period of time.

The fourth objective of the present invention is to provide angle-detecting equipment by which (regardless of the distance between the detecting sensor and the object and the presence of contaminated lubricant oil that has been filled and sealed into said device for controlling the drilling direction) an absolute value of the angle from the original reference point of the first and second ring-formed components can be accurately and stably detected under the presence of hostile environments including the high temperature and pressure at the bottom area of the well conduits, which are normally located at several hundreds or thousands of meters underneath the ground surface ground; detection of the original reference point and angle can be achieved by using only one sensor; and the undesired attenuation due to length of cables between the sensor and the controlling device and noises will hardly influence the detection accuracy.

DISCLOSURE OF INVENTION

After conducting diligent and continuous research and development to achieve the aforementioned first objective, the present inventors have found that the fulcrum bearing functions not only as a thrust bearing to receive the bit load, but it also serves as a rotating center when the direction along the lateral axial direction of the rotating shaft at the double eccentric mechanism changes by depositing the fulcrum bearing at the midpoint between the drill bit and the double eccentric mechanism and by providing a flexible joint with the upper bearing at upper portion of the double eccentric mechanism in order to absorb the displacement of the rotating shaft in the lateral axial direction. Furthermore, it was found that the lower sealing can be deposited close to the fulcrum bearing, in order to displace the drill bit in the opposite direction, resulting in the magnitude of the displacement of the rotating shaft on the lateral axial direction at the lower sealing portion being minimized and simplified. Moreover, it was noted that the displacement of the rotating shaft in the lateral axial direction can be absorbed by the flexible joint and an excessive bending stress on the rotating shaft can be prevented.

Next, in order to achieve the second objective of the present application, it was found that the deflection generated at the rotating shaft can be absorbed and leaking-out of the muddy water flowing inside the rotating shaft can be prevented by providing a through-hole at a midpoint of the cross-pin which connects a hollow yoke and a hollow center shaft having hollow yokes at both ends, by inserting a seal tube inside the connecting portion for the hollow yoke, having hollow yokes at both end portions of the hollow center shaft, and the cross-pin, and by sealing said connecting portion.

In order to achieve the third objective of the present application, after continuous and diligent research and development, the present inventors have found that (i) the displacement of the rotating shaft in the lateral axial direction can be absorbed by inserting the universal joint as a part of the rotating shaft when the controlling device is about to change the drilling direction of the drill, (ii) the portion of the rotating shaft above the universal joint does not move along the axial direction, (iii) the displacement of the rotating shaft below the universal joint in the lateral axial direction can be absorbed by flexibly joining the seal box and a cylinder-type housing, and (iv) the leaking-out of the lubricant oil which has been filled and sealed inside the device for controlling the drilling direction of drills and the leaking-in of the muddy water can be prevented for a long period of time by providing sealing equipment close to the bearing shaft of the rotating shaft above the universal joint through a pressure-equalizing mechanism, thus separating the lubricant oil and the muddy water.

Moreover, in order to achieve the fourth objective of the present application, extensive research made us conclude that the position of the absolute value of the angle of the ring-formed components can be detected to a greater accuracy by using a resolver known as a angle detecting sensor by which a mechanical angular displacement is converted to electrical signals, by depositing a resolver with a hollow rotor close to both sides of the double eccentric mechanism of the drills, by connecting the hollow rotor and ring-shaped components, and by connecting directly the hollow-type harmonized reduction gear to one end portion of the hollow rotor.

With the aforementioned structures, according to the present invention, the flexible joint which is going to be used for the device for controlling the drilling-direction of drills is not limited to a certain type, but can be any type if the deflection force generated by the displacement of the rotating shaft in the lateral axial direction can be absorbed by the double eccentric mechanism and the leaking-out of the muddy water flowing inside the rotating shaft can be avoided. However, (i) a hollow universal joint, in which a seal tube is inserted and engaged inside the connecting portion for a hollow yoke, a hollow center shaft and a cross-pin and both ends thereof are sealed, or (ii) a screw-connecting type hollow flexible tube using a material with a relatively lower value of modulus of elasticity, such as titanium or the like, can be utilized.

In the present invention, by providing a resolver between the first and second ring-formed components and hollow-type harmonized reduction gear, the absolute value of the positions of the rotating angles of the first and second ring-formed components can be detected with a better accuracy, and a precise and stable control of the drilling direction can be achieved. Moreover, the rotor of the resolver can serve also as a driving-force transferring component to transfer the out-put rotation from the harmonized reduction gear to the first and second ring-formed components, such that the whole unit can be formed in a compact structure.

Furthermore, concerning the device for controlling the drilling direction of drills in the present invention, since the fulcrum bearing of the rotating shaft is mounted between the drill bit and said first and second ring-formed components, then the fulcrum bearing functions as a thrust bearing to receive the bit load. Moreover, said fulcrum bearing serves as a rotation center of the rotating shaft at the double eccentric mechanism comprising said first and second ring-formed components when the lateral axial direction undergoes its change, causing the drill bit to move to the opposite direction. Hence furthermore having the following advantages.

(i) A lower sealing portion can be deposited close to the fulcrum bearing between the cylinder-type housing and the rotating shaft, and the magnitude of a displacement of the rotating shaft in the lateral axial direction at the lower sealing portion is small, permitting the sealing mechanism to be simplified.

(ii) Since the bit load can be transferred to the cylinder-type housing through the fulcrum bearing, the bit load is not acting directly from the rotating shaft to the double eccentric mechanism, thus protecting the double eccentric mechanism, which is a relatively weaker component from the standpoint of mechanical strength.

(iii) Since the fulcrum bearing is positioned close to the lower seal, the inclining angle of the rotating shaft with respect to the amount of displacement of the rotating shaft in a lateral axial direction can be larger at the lower sealing portion.

(iv) Since the distance between the drill bit and the fulcrum bearing can be shortened and there is no double eccentric mechanism involved therebetween, the rotating shaft can be made with a larger diameter and with higher rigidity, thus allowing the bit lateral load to be larger at the moment when the drilling direction is to be controlled.

Furthermore, in the present invention, by locating a flexible joint at the upper portion of the first and second ring-formed components and a bearing to support the rotating shaft at the upper portion thereof, the deflection force generated by the displacement of the rotating shaft in the lateral axial direction at the double eccentric mechanism can be absorbed and an occurrence of the excessive cyclic bending stress on the rotating shaft due to the displacement in the lateral axial direction can be prevented.

The hollow universal joint for drills, according to the present invention and as described in claim 2, can prevent the flowing-out of the fluid which is running from a connecting portion (for the hollow yokes for the upper and lower rotating shafts, hollow yokes at both ends of the hollow center shaft and a cross-pin) to the insides of said hollow structures even if the axial centers of the upper and lower rotating shafts are misaligned from an axial center of the hollow center shaft. This is mainly due to the facts that (1) a through-hole is provided at the central portion of the cross-pin and (2) sealing tubes are inserted and sealed in a waterproof manner at insides of the connecting portions between hollow yokes of upper and lower rotating shafts and a central yoke at an upper end of the hollow center shaft and between a hollow yoke of the lower rotating shaft and a hollow yoke at the lower end of the hollow center shaft.

The sealing tube used in the hollow universal joint is made of a resilient material such as synthetic rubber including urethane rubber, nitryl rubber or the like.

For installation of the seal tube in the device for controlling the drilling direction of drills, according to the present invention, both ends of the seal tube are squeezed and tightened to the upper and lower rotating shafts and a hollow center shaft, and the ends are fixed by applying adhesive agents, so that the distortion generated due to the misalignment between said upper and lower rotating shafts and the hollow center shaft can be absorbed by the elasticity of the sealed tube.

In the present invention, the deflection force caused by the displacement of the rotating shaft in the lateral axial direction in the double eccentric mechanism can be absorbed by the hollow universal joint by utilizing the hollow universal joint as a flexible joint, so that undesirable generation of an excessive repeated bending stress on the rotating shaft due to the displacement in the lateral axial direction can be prevented. Moreover, even if the axial centers of the upper and lower rotating shaft are misaligned with the axial center of the hollow center shaft, a flowing-out of the fluid, which is running from the connecting portion (for the hollow yoke of the upper and lower rotating shafts, a hollow yoke at both ends of the hollow center shaft and the cross-pin) to the inside said hollow portions can be prevented.

The pressure-equalizing equipment cited in claim 3 of the present invention comprises an upper sealing equipment which consists of: (1) a ring-shaped spacer embracing externally the rotating shaft through the bearing which is positioned right above the upper bearing; (2) a sealing mechanism being inserted between said ring-shaped spacer and the rotating shaft; (3) a piston located at the ring-shaped space formed between the circular spacer and the cylinder-type housing, said piston sliding due to the pressure difference between the lubricant oil that has been filled and sealed in the device for controlling the drilling direction of drills and the upper muddy water, and having a packing seal an both ends thereof and a slit at its outer peripheral surface for detecting the magnitude of the movement along the axial direction; and (4) a window hole which is located at said cylinder-type housing. When the pressure increases due to the thermal expansion of the lubricant oil (which has been filled and sealed between the pressure-equalizing equipment and the lower sealing equipment) in the high temperature environment at the bottom area of well conduits, the piston slides upward along the ring-shaped spacer until the pressure of the lubricant oil becomes equal to the pressure of the muddy water conduits. When the pressure of the muddy water increases said piston slides downward along the ring-shaped spacer until the pressure of the lubricant oil is equal to the pressure of the muddy water, the opposite direction from the above case.

Accordingly, by using the aforementioned pressure-equalizing equipment comprising the upper sealing equipment, the internal pressure of the lubricant oil, which has been filled and sealed between the upper sealing equipment and the lower sealing equipment, can equalize with the external pressure of the muddy water, thus exhibiting an almost nil pressure difference, so that the leaking-out of the lubricant oil from the pressure-equalizing equipment and lower sealing equipment, and leaking-in of the muddy water can be prevented.

Furthermore, by using the pressure-equalizing equipment, the position of said piston can be detected at the window-hole, which is located in the cylinder-type housing, by providing a plurality of splits on the outer peripheral surface of said piston for detecting the magnitude of the movement along an axial direction. By setting the piston position at the time when the lubricant oil is filled and sealed between the pressure-equalizing equipment and the lower sealing equipment, the capacity of the piston on the muddy water side as well as the capacity of the piston on the lubricant oil side can be arbitrarily changed in correspondence to the changes in temperature and pressure, so that the capacities of the piston on both the muddy water side and the lubricant oil side can be calculated in advance, thus setting the piston at a pre-determined position.

In the present invention, a combination of a mechanical seal and an O-ring can be employed as a sealing mechanism which is going to be inserted between the pressure-equalizing equipment and the lower sealing equipment.

In the sealing equipment of the device for controlling the drilling direction, as cited in claim 4 of the present invention, the lower sealing equipment comprises the following structures to achieve the effective functions which will be described in the next paragraph. Namely, said lower sealing equipment consists of: (1) a pair of a first hollow spherical surface components, which are connected to the lower portion of the cylinder-type housing; (2) a pair of a second hollow spherical surface components which are in contact with a convex surface component of said first spherical surface component; (3) a sealing mechanism which is provided at the boundary area of the concave/convex surfaces of the first and second spherical surface components; (4) a rotation stop pin to prevent the rotation of the lower sealing equipment along the lateral axial direction; and (5) a sealing mechanism, which is provided at a ring-shaped space area of the rotating shaft being inserted through the central portion of the second spherical surface component.

The thus structured lower sealing equipment exhibits the following functions. The rotation of the lower sealing equipment along the lateral axial direction is prevented by the rotation stop pin when the rotating shaft rotates. At the same time, although the rotating shaft inclines with respect to the central axis of the cylinder-type housing by changing action of the drilling direction caused by the device for controlling the drilling direction of the drills, the whole body moves so that it is inclined with respect to the distance from the spherical center of the first spherical surface component to the spherical center of the second spherical surface component as its rotating radius, thus having the spherical center of the first spherical surface component as its rotating center. There should not be any risks to damage or breakage on the sealing function because the rotating shaft, the convex surface component of the second spherical surface component and the sealing mechanism therebetween move in such a manner that they maintain parallelism among themselves.

Moreover, in the aforementioned sealing equipment of the controlling device, the upper sealing equipment comprises: (1) a bladder case which is deposited on the inner circular surface of the cylinder-type housing which is positioned close to the upper portion of the upper bearing through a bearing which is inserted between said inner circular surface and the rotating shaft; (2) a sealing mechanism which is provided between said bladder case and the rotating shaft, and (3) a bladder being stored inside the bladder case, with an internal portion of said bladder having a flow passage for the lubricant oil (which has been filled and sealed in the device for controlling the drilling direction) and the external portion of said bladder being in contact with the muddy water. Accordingly, when the lubricant oil, which is filled and sealed between upper and lower sealing equipments, expands due to the high temperature at the bottom area of the well conduits, the lubricant oil flows into the bladder through the flow passage and expands externally until the pressure of the expanding lubricant oil equalizes with the pressure of the muddy water. However, when the pressure of the external muddy water becomes higher, the lubricant oil in the bladder starts to flow-out in an opposite direction from the previous case through the flow passage, and the bladder will shrink to equalize the pressure between the internal lubricant oil and the external muddy water.

As a result of using the thus structured sealing equipment of the controlling device, the pressure difference can be made almost nil by equalizing the pressure of the internal lubricant oil (which has been filled and sealed between the upper sealing equipment and lower sealing equipment) with the pressure of the external muddy water, so that the leaking-out of the lubricant oil from the upper and lower sealing equipments and leaking-in of the muddy water can be prevented.

It is necessary for the bladder material, which forms a portion of the upper sealing equipment of the present invention, to withstand the high temperature and high pressure hostile environment at the bottom area of the well conduits, so that it should be made of synthetic rubber type resilient materials including urethane rubber, nitryl rubber or the like. Moreover, a combination of a mechanical seal and an O-ring can be utilized as a sealing mechanism which is going to be deposited between the upper and lower sealing equipments.

The lower sealing equipment in the device for controlling the drilling direction as described in claim 7 of the present invention consists of: (1) a seal box which is provided at the rotating shaft through a bearing; (2) a sealing mechanism which is deposited between said seal box and the rotating shaft; and (3) a bellows which connects the seal box and the lower portion of the cylinder-type housing. When the rotating shaft inclines with respect to the cylinder-type housing due to changes in the drilling direction by the device for controlling the drilling direction, the bellows which are mounted between the seal box and the lower portion of the cylinder-type housing start to deform and absorb the inclination along a lateral axial direction of the rotating shaft. Simultaneously, the seal box and sealing mechanism maintain the sealing mechanism since the seal box and sealing mechanism move in such a manner as to maintain their parallelism with the rotating shaft. Furthermore, the lubricant oil filled and sealed in a ring-shaped space area between the rotating shaft and the cylinder-type housing is sealed from the external portion through the bellows in such a way that the lubricant oil will not leak out.

The upper sealing equipment in the device for controlling the drilling direction cited in claim 7 of the present invention comprises: (1) a bladder case which is provided on circular inner peripheral surface of the cylinder-type housing close to the upper portion of the upper bearing through which the bearing is mounted between said inner surface and the rotating shaft; (2) a sealing mechanism, which is provided between the bladder case and the rotating shaft, and (3) a bladder which is stored inside the bladder case, the inner portion of said bladder possessing a flow passage for the lubricant oil (which has been filled and sealed in the device for controlling the drilling direction) and the outer portion of said bladder being in contact with the muddy water. With the thus structured upper sealing equipment, when the lubricant oil filled and sealed between the upper and lower sealing equipments starts to expand due to the high temperature at the bottom area of the well conduits, the lubricant oil flows in through the flow passage and expands externally until the pressure of the expanding lubricant oil equalizes with the pressure of the external muddy water. However, when the pressure of the external muddy water further increases, the lubricant oil in the bladder will flow-out in an opposite direction from the previous case, and the bladder shrinks, so that the pressure of the internal lubricant oil equalizes with the pressure of the external muddy water.

Therefore, the aforementioned sealing equipment functions to equalize the pressure of the internal lubricant oil filled and sealed between the upper and lower sealing equipments with the pressure of the external muddy water, so that the pressure difference between them will be almost nil. As a result, the leaking-out of the lubricant oil from the upper or lower sealing equipment and leaking-in of the muddy water can be prevented.

In the device for controlling the drilling direction of the present invention, it is required that the function of the bellows forming a portion of the lower sealing equipment should absorb the deflection along a lateral axial direction and withstand the sliding resistance of the mechanical seal as well as the hostile environment at the bottom area of well conduits, having the high temperature and pressure. Hence, the detailed design should be based on respective available data.

It is necessary for the bladder material, which forms a portion of the upper sealing equipment of the present invention, to withstand the high temperature and high pressure hostile environment at the bottom area of the well conduits, and so it should be made of synthetic rubber type resilient materials including urethane rubber, nitryl rubber or the like. Moreover, a combination of a mechanical seal and an O-ring can be utilized as a sealing mechanism which is deposited between the upper and lower sealing equipment.

In the angle detecting equipment employed in the device for controlling the drilling direction of the present invention, the displacement of the hollow rotor in the resolver becomes equal to the displacement of the ring-formed component by connecting directly the first ring-formed component to the hollow-type first harmonized reduction gear through a hollow rotor of the first resolver and by linking the second ring-formed component and the hollow-type second harmonized reduction gear to the hollow rotor of the second resolver and the Oldham centering coupling. Hence, when the wiring of the rotor of the resolver is magnetized with an alternating voltage, voltage being proportional to sin ($\theta$) and cos ($\theta$), where $\theta$ is a rotor's angle, will be generated on the respective two-phase wires of the stator which are perpendicular to each other. The rotating angle of the rotor can be detected by measuring the phase angle of these voltages. Hence, the position of the absolute value of the angle of the ring-formed component can be detected with an excellent accuracy, so that the drill bit stability can be precisely conducted. Moreover, since the hollow rotor of the resolver serves also as a transferring component of the driving force to transfer the rotation of the hollow-type harmonized reduction gear to the ring-formed component, the unit can be manufactured with a smaller and more compact structure.

For the present invention, the resolver can be a type with which the rotor wiring is either single or double. Since the rotating shaft moves along the center of the circular inner surface of the second ring-formed component as a single body, it is necessary for the rotor to be a hollow type.

The principal advantage of using the resolver with the device for controlling the drilling direction is based on the fact that the absolute value of the angle can be detected because it is a phase-detector. As a result, in comparison to the pulse-counting method employing a photo sensor or an eddy current sensor, it can, in principle, serve also as an original reference point detecting sensor.

Furthermore, since the resolver in the present invention has a low frequency drive signal and detecting signal, it is hardly influenced by the length of the cable. Hence, even if the distance between the resolver and the controlling device will become longer, the adverse effects from attenuation or noises might be very mild, so that a stable operation can be achieved. Moreover, in comparison to the pulse-counting method using a photo sensor or an eddy current sensor, the absolute value of the angle can always be detected, so that the self-diagnosis or monitoring of the movement of the double eccentric mechanism can be performed, and the original reference point can be arbitrarily set at a certain point digitally.

BRIEF DESCRIPTION OF DRAWINGS

The above and many other objects, features and advantages of this invention will be more fully understood from the ensuing detailed description of the preferred embodiment of the invention, which description should be read in conjunction with the accompanying drawings wherein.

BEST MODE FOR CARRING OUT THE INVENTION

Embodiment 1

Figure 1:
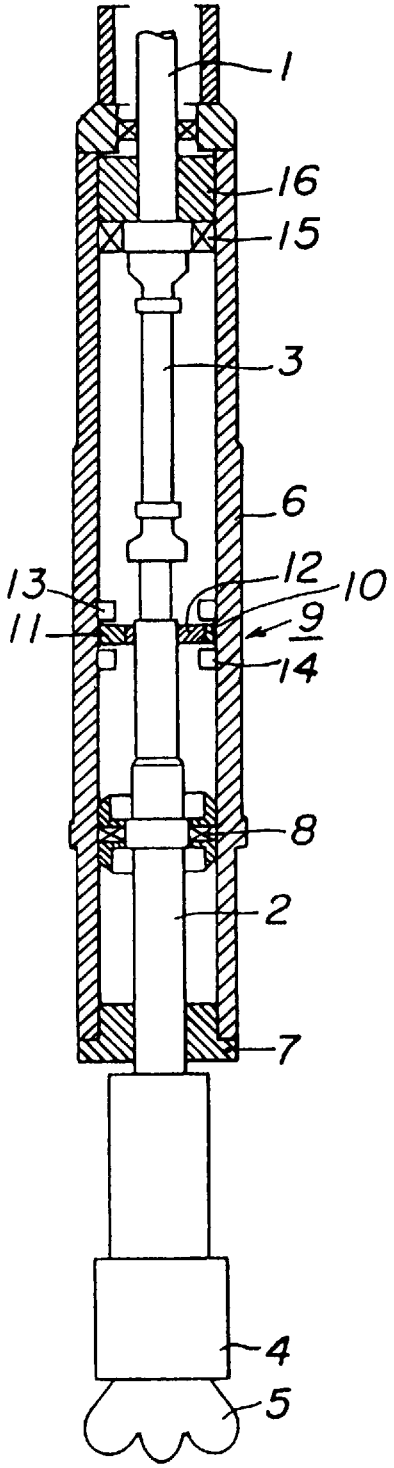
FIG. 1 is a general view depicting the structure of the device for controlling the drilling direction of drills when the rotating shaft is not in an eccentric position of the present invention.
Figure 2:
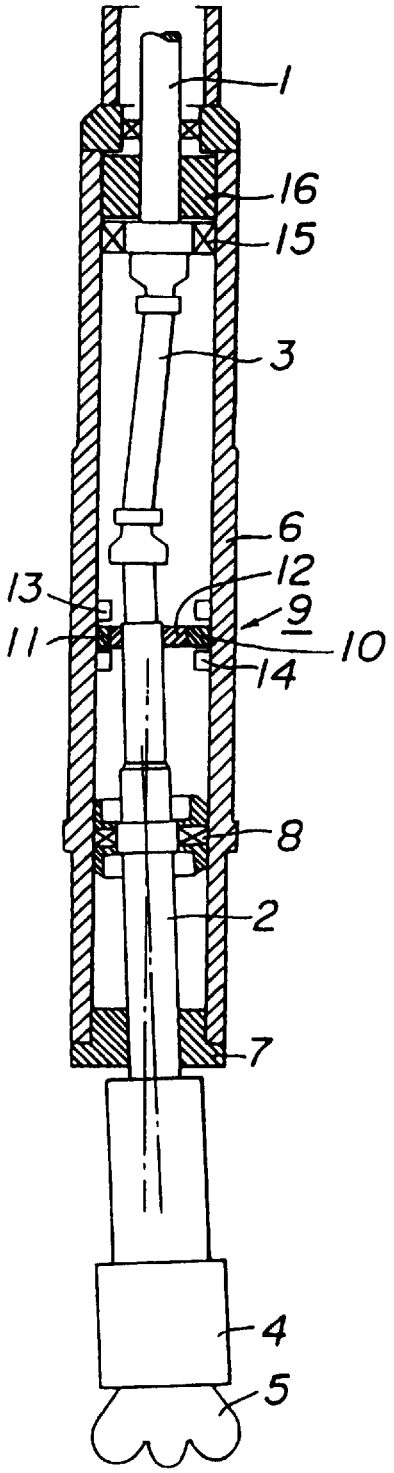
FIG. 2 is a general view showing a structure of the device for controlling the drilling direction of drills when the rotating shaft is in an eccentric position of the present invention.

The detailed description on the first embodiment of the device for controlling drilling direction of well drills, according to the present invention, will be conducted by referring to FIGS. 1 through 6. In FIGS. 1 and 2, there are an upper rotating shaft 1 for a rotary type drilling equipment and a lower rotating shaft 2 which is connected to the upper rotating shaft 1 and a flexible joint 3. There are also, in FIGS. 1 and 2, a drill collar 4 which is co-axially connected to the distal end portion of the lower rotating shaft 2 and a drill bit 5 which is secured at the distal end of the drill collar 4. Furthermore, the upper rotating shaft 1 is connected to a rotating driving mechanism (not shown).

Furthermore, there are a cylinder-type housing 6 which is located in such a manner that said housing encloses an outer peripheral surface of said upper and lower rotating shafts 1,2 above the drill collar 4 and the lower sealing equipment 7 which is provided between the distal end portion of the cylinder-type housing 6 and the lower rotating shaft 2.

Moreover, FIGS. 1 and 2 also show: a fulcrum bearing 8 which is located between the cylinder-type housing 6 of the lower sealing equipment 7 and the lower rotating shaft 2 and receives the load from the drill bit 5; a double eccentric mechanism 9 which is mounted between the cylinder type housing 6 above the fulcrum bearing 8 and the lower rotating shaft 2; a cylinder-type component 10 which is fixed on an inner peripheral surface of the cylinder type housing 6; a first rotatable ring-formed component 11 which is located inside the cylinder type component 10; and a second ring-formed component 12 which is rotatably deposited inside the first ring-formed component 11.

There are also, in FIGS. 1 and 2, a first harmonized reduction gear 13 which rotates said first ring-formed component 11 which is located right above the double eccentric mechanism 9, a second harmonized reduction gear 14 which rotates said second ring-formed component 12 being provided right below the double eccentric mechanism 9, a bearing 15 which supports the lower portion of the upper rotating shaft 1, and an upper seal 16 which is provided between the upper portion of the cylinder type housing 6 and said upper rotating shaft 1.

Figure 3:
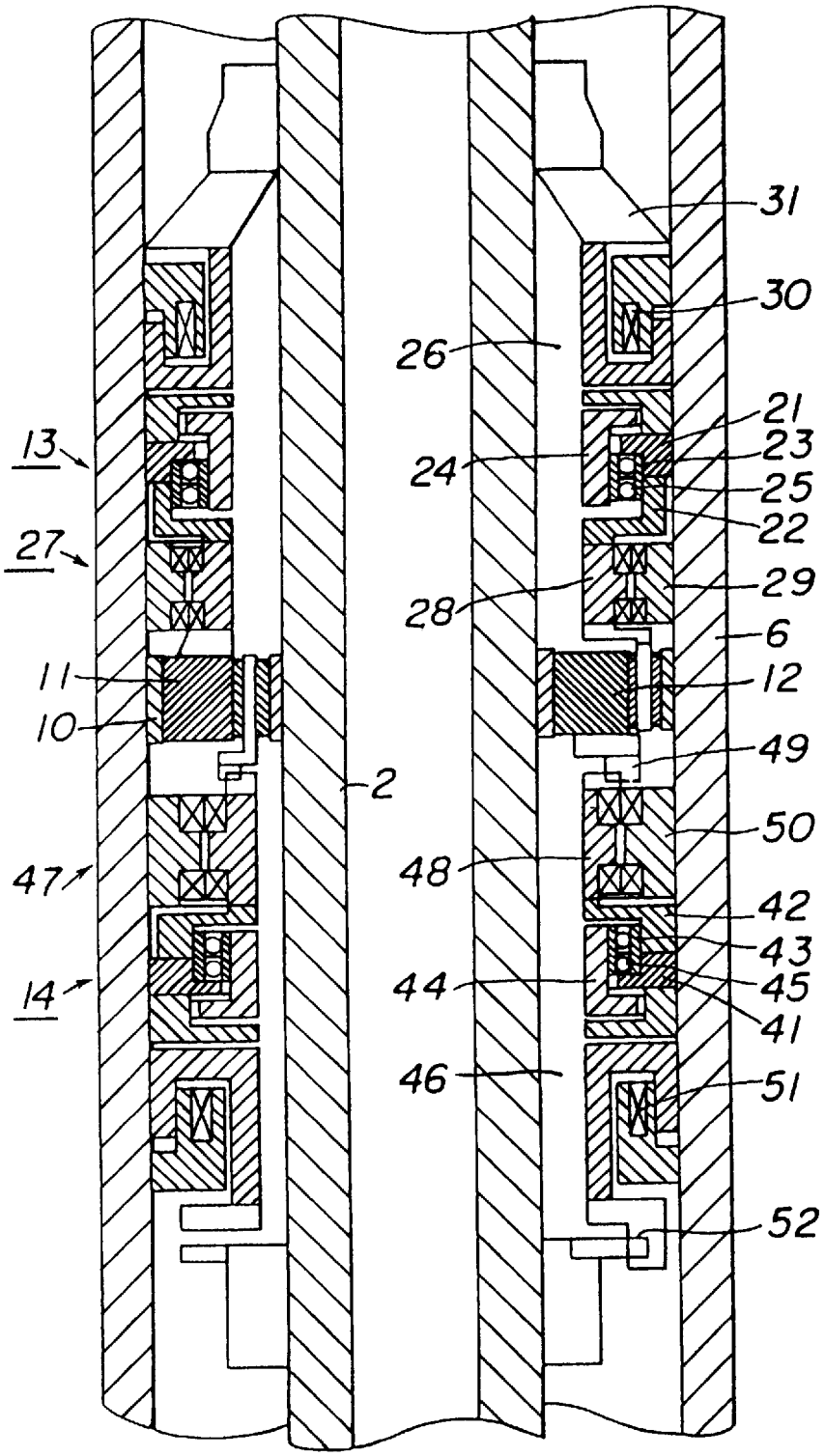
FIG. 3 is a detailed vertical cross sectional view of the device for controlling the drilling direction of drills according to the present invention.

The first harmonized reduction gear 13, as seen in FIG. 3, is structured with a first and second ring-formed rigid internal gears 21,22, a ring-formed flexible external gear 23 which is mounted inside of said internal gears 21,22, and an oval-shaped wave-generator which is provided inside the ring-formed flexible external gear 23.

The wave-generator comprises an oval-shaped rigid cam plate 24 and a bearing 25 which is inserted between outer periphery of the rigid cam plate 24 and the flexible external gear 23. At a central portion of the oval-shaped rigid cam plate 24, there is a hollow portion 26 through which the lower rotating shaft 2 is inserted, allowing it to have a certain amount of a clearance.

The first rigid internal gear 21 is fixed on the inner periphery of the cylinder-type housing 6. One end of a hollow rotor 28 of a resolver 27 is connected to the second rigid internal gear 22. The other end of the hollow rotor 28 is directly connected to the first ring-formed component 11. A stator 29 of the resolver 27 is secured at an inner periphery of cylinder-type housing 6. The second rigid internal gear 22, the hollow rotor 28 and the first ring-formed component 11 rotate as a unit body.

The wave generator is directly linked to the lower rotating shaft 2 through an electromagnetic clutch brake mechanism 30 and a first Oldham coupling 31. Once the rotational force of the lower rotating shaft 2 is transferred to the first harmonized reduction gear by operating the electromagnetic clutch brake mechanism 30, the first ring-formed component 11 will start to rotate through the hollow rotor 28 of the resolver 27 after the reduction of rotation at a certain level of reduction ratio determined at the first harmonized reduction gear 13.

The second harmonized reduction gear 14 consists of; first and second ring-formed rigid internal gears 41,42; a ring-formed external gear 43 which is deposited therein; and an oval-shaped wave generator which is provided therein. The wave generator is further structured with an oval-shaped rigid cam plate 44, and a bearing 45 which is inserted between the outer periphery of the rigid cam plate 44 and the rigid external gear 43. A central hollow portion 46 is formed at the center of the oval-shaped rigid cam plate 44, through which the lower rotating shaft 2 is inserted in order to maintain a certain amount of a clearance.

Said first rigid internal gear 41 is secured at the inner periphery of the cylinder-type housing 6. One end of a hollow rotor 48 of a resolver 47 is connected to the second rigid internal gear 42. The other end of the hollow rotor 48 is linked to the second ring-formed component 12 through an Oldham type centering coupling 49. A stator 50 of the resolver 47 is fixed at the inner periphery of the cylinder-type housing 6. The second rigid internal gear 42, the hollow rotor 48 and the second ring-formed component 12 rotate through the Oldham type centering coupling as a unit body.

The wave generator is connected to the lower rotating shaft 2 through a second Oldham coupling 52 of an electromagnetic clutch brake mechanism 51. When the rotation force of the lower rotating shaft 2 is transferred to the second harmonized reduction gear 14 by operating the electromagnetic clutch brake mechanism 51, the second ring-formed component 12 will start to rotate through the hollow rotor 48 of the resolver 47 and the Oldham type centering coupling 49 after the reduction of rotation at a certain level of reduction ratio by the second harmonized reduction gear 14.

Figure 4:
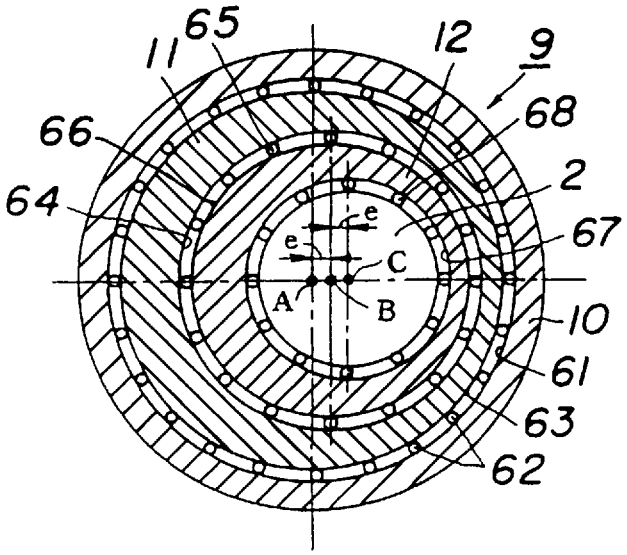
FIG. 4 is a detailed horizontal cross sectional view of the double eccentric mechanism used for the device for controlling the drilling direction according to the present invention.

In the cylinder component 10, which is the most outer component of the double eccentric mechanism 9 shown in FIG. 4, a circular inner surface 61 is formed which has a shaft center being defined by the fulcrum bearing 8; namely, the center of said circular inner surface 61 is located on the rotating shaft axis A. A circular outer surface 63 of the first ring-formed component 11 is rotatably supported through a roller bearing 62.

In the first ring-formed component 11, a circular inner surface 64 is formed which has a center at a location B (see FIG. 4) which is shifted by the distance "e" from the shaft rotating axis A. A circular outer surface 66 of the second ring-formed component 12 is rotatably supported through a roller bearing 65. In the second ring-formed component 12, a circular inner surface 67 is formed which has a center C that is shifted by an equal distance "e" with respect to the center point B of the circular outer surface 66. The outer peripheral surface of the lower rotating shaft 2 is rotatably supported through a roller bearing 68.

Figure 5:
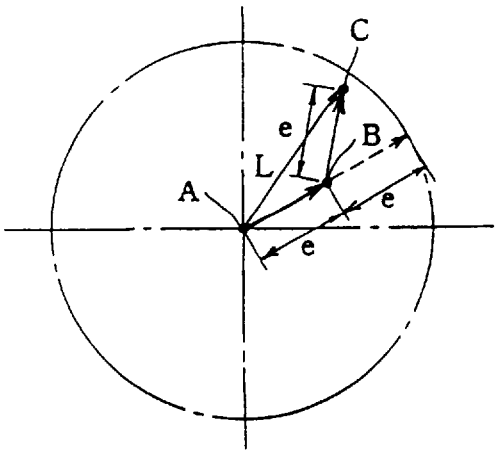
FIG. 5 is a figure to explain the operation of the device for controlling the drilling direction of drills of the present invention.

In the double eccentric mechanism 9, a center C of the circular inner surface 67 of the second ring-formed component 12 which supports the lower rotating shaft 2 can move a certain distance to an arbitrary direction by controlling a rotating angle position and relative rotating magnitude of the first and second ring-formed components 11,12, Namely, as seen in FIG. 5, since the center B of the circular inner surface 64 of the first ring-formed component 11 is shifted by the distance "e" with respect to the center A of the shaft rotation, then a circle with a radius "e" having its center at the center point A of the shaft rotation will define a movement locus. Moreover, since the center point C of the circular inner surface 67 of the second ring-formed component 12 is shifted with the distance "e" with respect to the center point B for said movement locus, a circle with the radius "e" having the center point B will also define a movement locus.

Accordingly, the center point C of the circular inner surface 67 of the second ring-formed component 12 can shift to an arbitrary position within a circle with a radius "e" having a shaft rotating axis as its center by controlling the rotating angle and relative rotating amount of the first and second ring-formed components 11,12. As a result, the portion of the lower rotating shaft 2, which is supported inside the double eccentric mechanism 9, can move a maximum distance "e" toward an arbitrary direction on a plane which is perpendicular to the rotating axis.

The center point of a lower portion of the lower rotating shaft 2 is confined to the shaft rotating axis A by the fulcrum bearing 8. Hence, as seen in FIG. 2, a progressing (drilling) direction of the distal portion of the lower rotating shaft 2 is shifted toward a direction along a line segment L which is connecting the center point A of the fulcrum bearing 8 and the center point C of the circular inner surface 67 of the second ring-formed component 2 at the double eccentric mechanism 9.

In this case, since the lower rotating shaft 2 and upper rotating shaft 1 are connected through the flexible joint 3, then the bending stress caused by a displacement along a direction being perpendicular to the axis of the lower rotating shaft 2 is absorbed, so that there would not be any deflection either at the upper rotating shaft 1 or lower rotating shaft 2.

In this embodiment, since the magnitude of the eccentricity of the center points B and C for the circular inner surfaces 64,67 formed by the respective first and second ring-formed components 11,12 is "e", then the center point C of a portion of the lower rotating shaft 2 passing through the double eccentric mechanism 9 is positioned on the rotating axis A of the shaft in a case when the drilling direction does not needed to be controlled.

Figure 6:
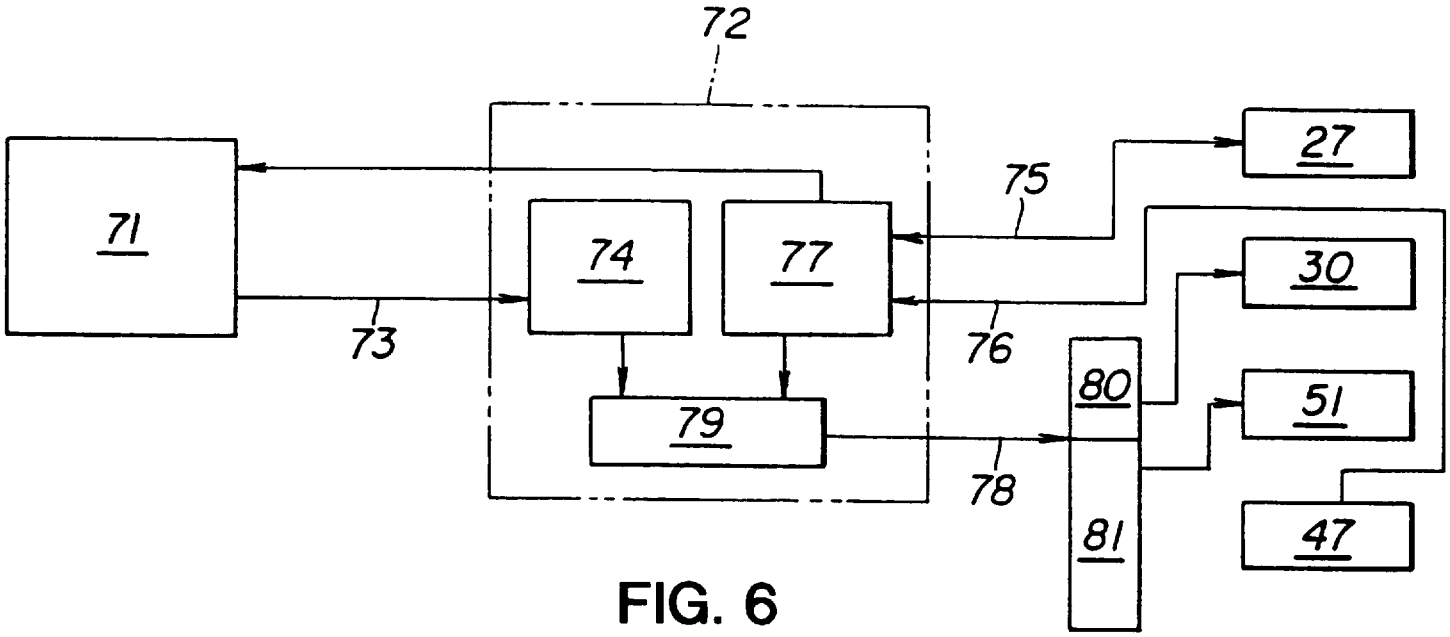
FIG. 6 is a general block diagram showing the sequences of the controlling system which is utilized by the device for controlling the drilling direction of drills in the present invention.
Figure 7:
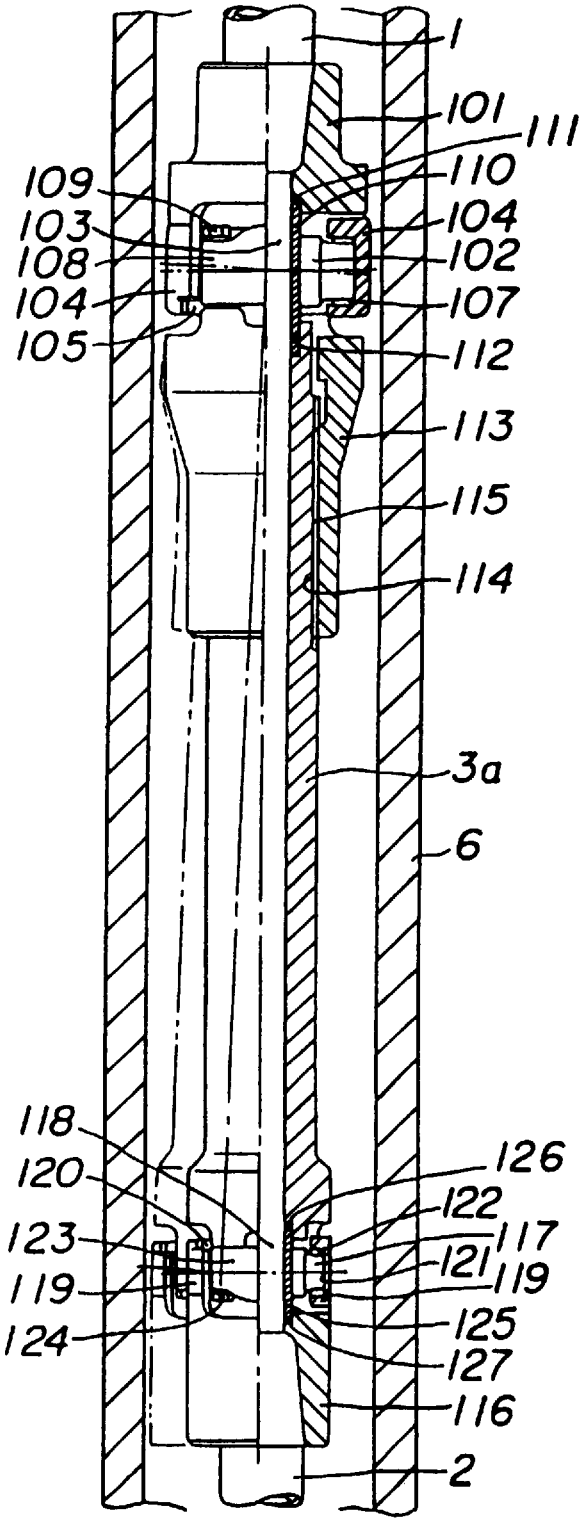
FIG. 7 is a side view of the connecting portion of a hollow-type universal joint according to the present invention.
Figure 8:
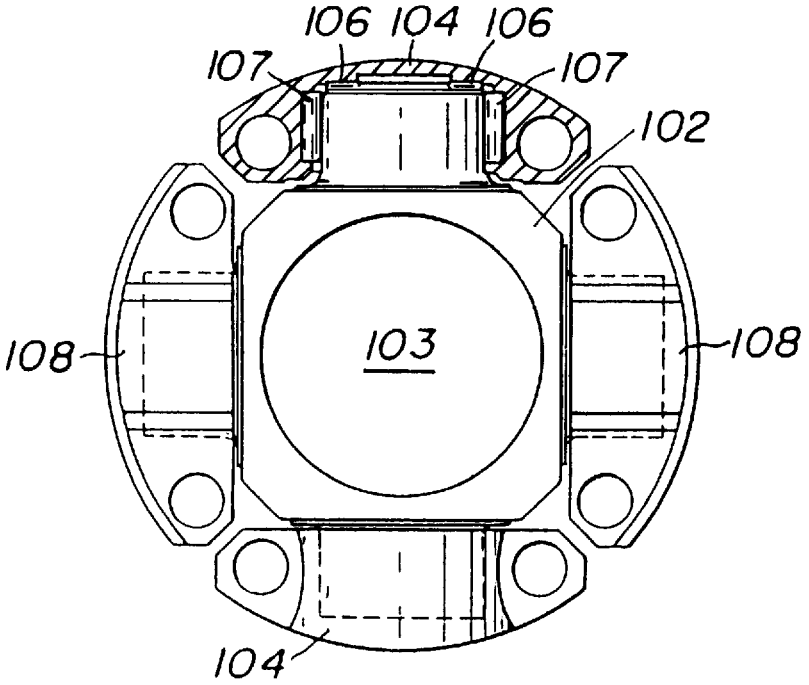
FIG. 8 is a partially enlarged cross sectional view of a cross-pin connecting portion of the hollow-type universal joint of the present invention.
Figure 9:
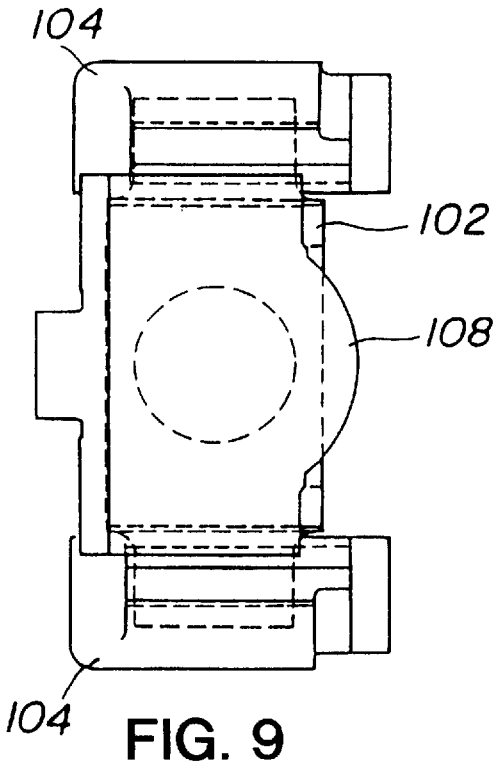
FIG. 9 is a side view of the cross-pin connecting portion of the hollow-type universal joint of the present invention.
Figure 10:
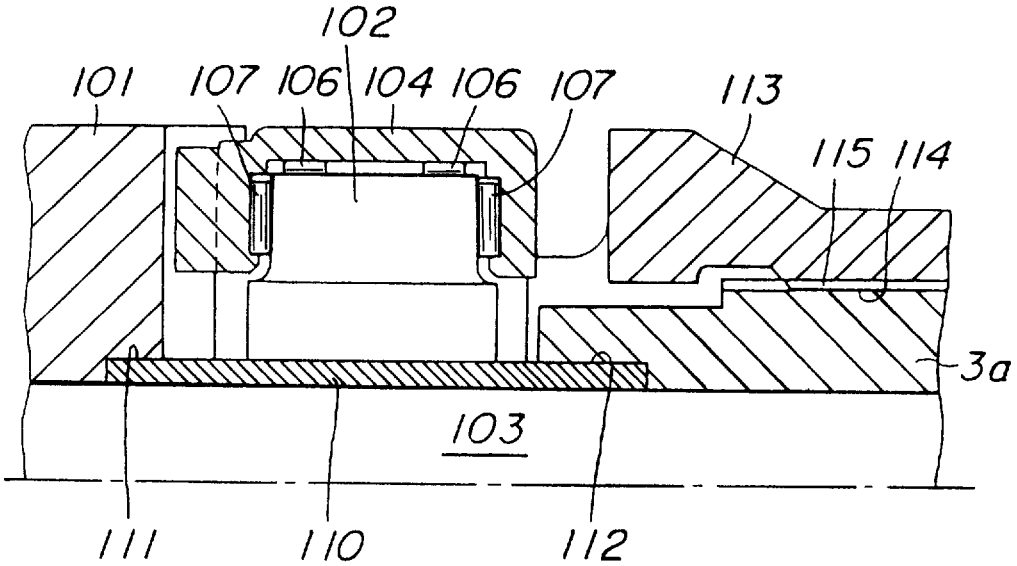
FIG. 10 is an enlarged view of a portion to deposit the seal tube of the hollow-type universal joint of the present invention.

In FIG. 6, there are a host computer 71 to conduct an overall driving control of the drills and a controller 72 for the controlling device for the drilling direction, and command signal 73 of direction and angle for defining the drilling direction from the host computer 71 is input. The controller 72, based on the direction and angle command signals 73 to define the drilling direction being input from the host computer 71, has a computation portion 74 of the target rotating position to calculate the target rotating position of the first and second ring-formed components 11,12.

Moreover, the controller 72—being based on the angle detection signals 75,76 from respective resolvers 27,47 which are provided between the first and second ring-formed components 11,12 and the first and second harmonized reduction gears 13,14—has a computation portion 77 to calculate the actual rotating position of the first and second ring-formed components 11,12. Furthermore, the controller 72 has a driving signal command portion 79 which outputs the driving control signal 78 to conduct the driving control of the first and second harmonized reduction gears 13,14, in order to equalize the actual rotating positions of the first and second ring-formed components 11,12 to the target rotating positions.

The driving control signal 78 coming from the driving signal command portion 79 is further output to driving control units 80,81 of the first and second harmonized reduction gears 13,14. Once the driving control signal 78 is input from the driving signal command portion 79, the driving control units 80,81 control the electromagnetic clutch brake mechanisms 30,51 connected to the first and second Oldham couplings 31,52, so that the first and second harmonized reduction gears 13,14 are driven; and, after the reduction to a certain level of reduction ratio, the first and second ring-formed components 11,12 will rotate to the respective target rotating positions through the hollow rotors 28,48 of the respective resolvers 27,47. The driving control of the first and second ring-formed components 11,12 can be achieved by executing the control program which is previously stored in the host computer 71.

By having the aforementioned structures, when the drilling direction of the drill is required to change, the controller 72 calculates the target rotating positions of the first and second ring-formed components 11,12 by the target rotating position computation portion 74 and outputs to the driving signal command portion 79, based on the input command signal 73 of direction and angle in order to define the drilling direction, after the command signal 73 on the direction and angle for defining the drilling direction is output from the host computer 71 to the controller 72.

On the other hand, the actual rotating position computation portion 77 calculates the actual rotating positions of the first and second ring-formed components 11,12 and outputs to the driving signal command portion 79, based on the angle detecting signals 75,76 from the resolvers 27,47 which are deposited between the first and second ring-formed components 11,12 and the first and second harmonized reduction gears 13,14.

When the target rotating position of the first and second ring-formed portions 11,12 is input from the target rotating position computation portion 74, the driving signal command portion 79 outputs the driving command to the driving control units 80,81. Moreover, based on the actual rotating position—which is input from the actual rotating position computation portion 77—of the first and second ring-formed components 11,12, the driving control signal 78 is output to the driving control units 80,81 to control the driving of the first and second harmonized reduction gears 13,14 so that the rotating positions of the respective first and second ring-formed components 11,12 can be found in the target rotating positions.

When the driving command is input from the driving signal command portion 79, the driving units 80,81 control the electro-magnetic clutch brake mechanisms 30,51. Moreover, the rotating force of the lower rotating shaft 2 is transferred to the first and second harmonized reduction gears 13,14 through the first and second Oldham couplings 31,52. Furthermore, based on the driving control signal 77 which is input from the driving signal command portion 79, said driving control units 80,81 change the rotating angle position and relative rotating magnitude of the first and second ring-formed components 11,12. After being reduced at a certain level of the reduction ratio in order for the rotating angle of the first and second ring-formed components 11,12 to be at the respective target rotating positions, the driving control units 80,81 rotate the first and second ring-formed components 11,12 to the respective target rotating positions through the hollow rotors 28,48 in the resolvers 27,47 and hold them at the target positions.

By the above procedures, the lower rotating shaft 2 passing through the circular inner surface 67 of the second ring-formed component 12 can incline with a desired magnitude in an arbitrary direction in the plane which is perpendicular to the rotating axis in a such a manner that the fulcrum bearing 8 serves as its center.

In this case, the bending stress on the upper rotating shaft 1 caused by the displacement along a lateral axial direction, which is a center for the fulcrum bearing 8 of the lower rotating shaft 2, can be absorbed by the flexible joint 3. Furthermore, the deflection on the upper rotating shaft 1 and the lower rotating shaft 2 can be remarkably reduced, resulting in said rotating shafts being used for a long period of time.

In the present embodiment, by positioning the resolvers 27,47 at a location between the first and second harmonized reduction gears 13,14 and the first and second ring-formed components 11,12, the absolute values of the rotating angle positions of the first and second ring-formed components 11,12 can be detected with a great accuracy, and stable control of the drilling direction can be precisely achieved.

Moreover, by connecting the first and second harmonized reduction gears 13,14 directly to the first and second ring-formed components 11,12 through the hollow rotors 28,48, said resolvers 27,47 have another function of transferring the driving force, that is to transfer the output rotation of the first and second harmonized reduction gears 13,14 to the first and second ring-formed components 11,12. As a result, it can be formed in a compact structure.

Furthermore, in the present invention, by positioning the fulcrum bearing 8 at the midpoint between the drill bit 5 and the double eccentric mechanism 9, the fulcrum bearing 8 functions not only as a thrust bearing to receive the load of the drill bit 5 but also serves as a rotating center for the lower rotating shaft 2 at the displacing along the lateral axial direction, so that the drill bit 5 can be displaced in the opposite direction to the inclining direction of the double eccentric mechanism portion.

By positioning the lower seal 7 at a midpoint between the drill bit 5 and the fulcrum bearing 8, the present invention allows the displacement along the lateral axial direction of the lower rotating shaft 2 at the lower seal 7 to be small, so that the sealing mechanism can be simplified. At the same time, the inclining angle of the lower rotating shaft 2 at the lower seal 7 can be made larger. Moreover, the size of the lower rotating shaft 2, located between the lower seal 7 and the drill collar 4, can be made to be a larger diameter, leading to greater rigidity. Accordingly, the lateral bit load at the controlling operation for the drilling direction is allowed to be large.

Embodiment 2

The detailed function and structure of the hollow universal joint of the present invention will be described by referring to FIGS. 7 through 10.

In FIGS. 7 through 10, there are a first hollow yoke 101 which is connected to a lower end potion of the upper rotating shaft 1 and a first cross-pin 102 having a through-hole 103 at a center portion of said cross-pin. There are also a bearing case 104 which is secured at above and below the first hollow yoke 101 by a bolt 105; a thrust needle 106; and a roller 107 which are provided between the bearing case and the first cross-pin 102. There is a bearing case 108, which is fixed by a bolt 109 at both sides of a sleeve (which will be described later) of the hollow center shaft 3*a*; and a thrust needle and a roller (not shown) are provided at a location between the first cross-pin 102 and the bearing case, in a same manner as the previous case.

There are also a first flexible seal tube 110 which is inserted through the through-hole 103 of the cross-pin 102 located at the connecting portion of the first hollow yoke 101, the hollow center shaft 3*a* and the first cross-pin 102. One end portion of said flexible seal tube is secured to an inner circular groove 111 being provided on the inner surface of the first hollow yoke 101 by using an adhesive agent. The other end of the first seal tube 110 is also fixed and sealed to an inner circular groove 112 provided at an end portion of the hollow center shaft 3a by using an adhesive agent.

There is also a sleeve 113, which has a convex projection 115 to engage with an outer peripheral groove 114 on a axial direction of the hollow center shaft 3*a* and slides along the axial direction of the hollow center shaft 3*a*. The bearing case 108 is fixed to both sides of said sleeve 113 by bolts 109.

The muddy water, which is flowing from the upper rotating shaft 1 through the inside of the hollow yoke 101 and the hollow center shaft 3*a*, is sealed with the first seal tube 110 which is inserted through the through-hole 103 of the first cross-pin 102 at the connecting portion of the first hollow yoke 101 and the hollow center shaft 3*a*. Even if the connecting angle between the first hollow yoke 101 and the hollow center shaft 3*a* is altered, the muddy water will still be sealed due to the fact that the changes in the connecting angle are absorbed by the resiliency of the first seal tube 110, and the shrinkage/expansion caused by the changes in the connecting angle between the first hollow yoke 101 and the hollow center shaft 3*a* will be absorbed by the sliding motion of the sleeve 113.

In FIGS. 7 through 10, there are also a second hollow yoke 116, which is connected at upper portion of the lower rotating shaft 2; a second cross-pin 117; and a through-hole 118 is provided at the center portion thereof in a similar manner to said first cross-pin 102. There are a bearing case 119, which is secured at both above and below the second hollow yoke 116 by a bolt 120; a thrust needle 121; and a roller 122 is provided with the second cross-pin 117. There is, furthermore, a bearing case 123, which is fixed at both sides of the hollow center shaft 3*a* with a bolt 124. A thrust needle and a roller (not shown) are provided at the second cross-pin 117 in a similar manner to the previous case.

There are a second seal tube 125 which is inserted through the through-hole 118 of the cross-pin 117 of the connecting portion of the second hollow yoke 116, the hollow center shaft 3*a*, and the second cross-pin 117. One end portion of said second seal tube 125 is fixed at an inner circular groove 126 which is positioned at the inner surface of the hollow center shaft 3*a* by an adhesive agent. The other end portion of the second seal tube 125 is secured with an adhesive agent at the inner circular groove 127 located at an edge portion of the second hollow yoke 116. Hence, even if the connecting angle between the second hollow yoke 116 and the hollow center shaft 3*a* is changed, the changes in the connecting angle will be absorbed by the resiliency of the second seal tube 125, and a tight seal will be maintained.

By using the aforementioned structures, the muddy water—which flows through the upper rotating shaft 1, the through-hole 103 of the first cross-pin 102, the hollow center shaft 3*a*, the through-hole 118 of the second cross-pin 117 and the lower rotating shaft 2—is sealed by the first and second seal tubes 110,125, which are inserted through the through-holes 103,118 of the first and second cross-pins 102,117 of the universal joint. Accordingly, there would be no leakage of the muddy water into the space formed between the cylinder-type housing 6 and upper and lower rotating shafts 1,2.

Furthermore, when the drilling direction is required to be changed, as seen in FIG. 2, the lower rotating shaft 2 is shifted toward the axial angle direction having the fulcrum bearing 8 as its center by two of the eccentric plates 11,12 of the double eccentric mechanism portion 9. However, since the deflection will be absorbed at the first and second cross-pin portions 102,117 of the universal joint being inserted at both ends of the hollow center shaft 3*a*, the deflection of the lower rotating shaft 2 provided by the double eccentric mechanism portion 9 does not generate bending force which is transferred from the double eccentric mechanism portion 9 to the lower rotating shaft 2 located therebelow. As a result, the fatigue life of the hollow center shaft 3*a*, as well as the upper rotating shaft 1, can be greatly enhanced.

Moreover, the first and second seal tubes 110,125, which are inserted through the through-holes 103,118 of the first and second cross-pins 102,117 being deposited at the first and second hollow yokes 101,116 and at both ends of the hollow center shaft 3*a*, are fixed and sealed in the inner peripheral grooves 112,126 located at both sides of the hollow center shaft 3*a* and in the inner peripheral grooves 111,127 of the first and second hollow yokes 101,116. As a result, the muddy water flowing inside the shaft will not leak out to the space formed between the cylinder-type housing 6, the lower rotating shaft 2, and the hollow center shaft 3*a*.

Furthermore, when the connecting angle between the first and second hollow yokes 101,116 and the hollow center shaft 3*a* is altered, although the first and second seal tubes 110,125, which are inserted through the through-holes 103, 118 of the first and second cross-pins 102,117, will deform due to the elastic force, the seal will still be maintained.

Moreover, the thrust force of a rotor in the mud-motor for driving the rotating shaft, which is connected to the upper portion of the cylinder-type housing 6, is acting downwardly during the drill. However, the deflection of the rotating shaft, which is generated during the changing the lower rotating shaft 2 toward the lateral axial direction with the fulcrum bearing 8 as its center, is absorbed at the first and second cross-pins 102,117 inserted at both ends of the hollow center shaft 3*a*, so that the upper rotating shaft 1, which is connected to the upper portion of the hollow center shaft 3*a*, will not move along the axial direction.

Accordingly, since the thrust bearing can be employed to receive the thrust force of the rotor in the mud-motor, the bearing 15 does not transfer the thrust force of the rotor in the mud-motor to the lower rotating shaft 2 located below the hollow center shaft 3*a*. Thus a large thrust force will not act on the relatively small diameter portion of the lower rotating shaft 2 located above the fulcrum bearing 8. As a result, the fatigue strength of the shaft will be greatly improved.

Embodiment 3

Figure 11A:
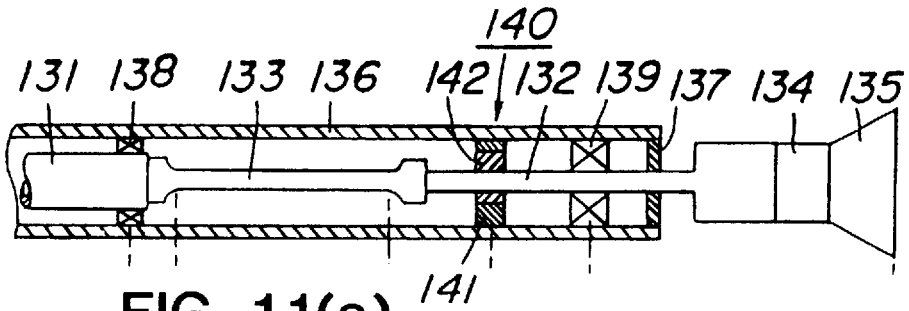
FIG. 11 is a stress profile obtained by the Finite Element Method (FEM) model, wherein (a) indicates locations selected for the FEM analysis of the device for controlling the drilling direction of oil well drills and (b) shows a relationship between the obtained stress (bending stress) and the distance from the upper bearing portion.
Figure 11B:
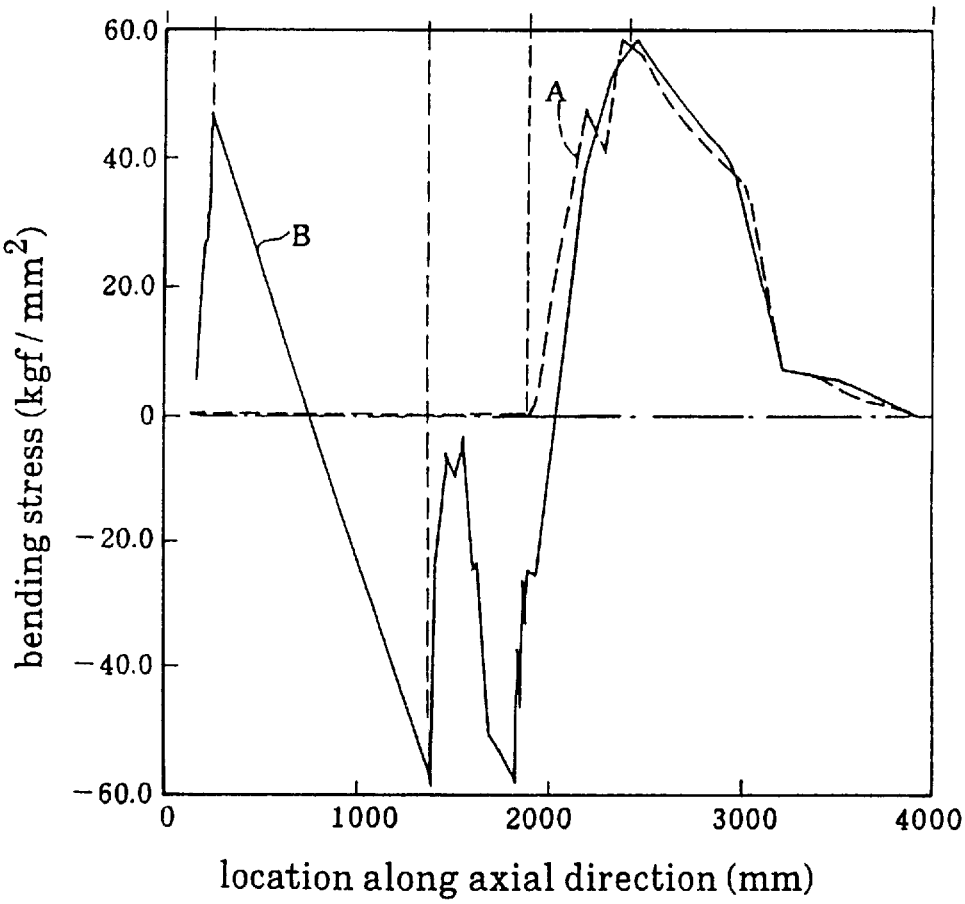

As seen in FIG. 11(*a*), there are an upper rotating shaft 131 and a lower rotating shaft 132 for drills. FIG. 11(*b*) shows results of a stress analysis using the Finite Element Method (FEM) for a case A, when said upper and lower rotating shafts are connected to a universal joint through a hollow center shaft 133, and a case B, when the upper rotating shaft 131 and the lower rotating shaft 132 are connected to the hollow flexible joint by screws.

In FIG. 11(*a*), there are also a drill collar 134, a drill bit 135, a cylinder-type housing 136, a lower seal 137, a bearing 138, a fulcrum bearing 139, and a double eccentric mechanism portion 140 comprising two eccentric plates 141,142.

When the upper rotating shaft 131 and the lower rotating shaft 132 are connected to the universal joint through the hollow center shaft 133, the deflection of the rotating shaft caused by the double eccentric mechanism portion 140 is absorbed by the universal joint deposited at both sides of the hollow center shaft 133, so that the bending stress, as seen in the curve A in FIG. 11(*b*), is not generated at the upper rotating shaft from the double eccentric mechanism portion 140. As a result, the fatigue lives of the hollow center shaft 133 as well as the upper rotating shaft 131 will be greatly enhanced.

On the other hand, when the upper rotating shaft 131 and the lower rotating shaft 132 are connected to the hollow flexible joint by screws, as seen in the curve B in FIG. 11(*b*), it was found that the maximum bending stress of 58 kgf/$mm^2$ was generated at the hollow flexible joint portion.

Embodiment 4

By referring to FIGS. 1 and 2 and being based on FIGS. 12 and 13, the pressure-equalizing equipment for the device for controlling the drilling direction of the drills will be described as follows.

Figure 12:
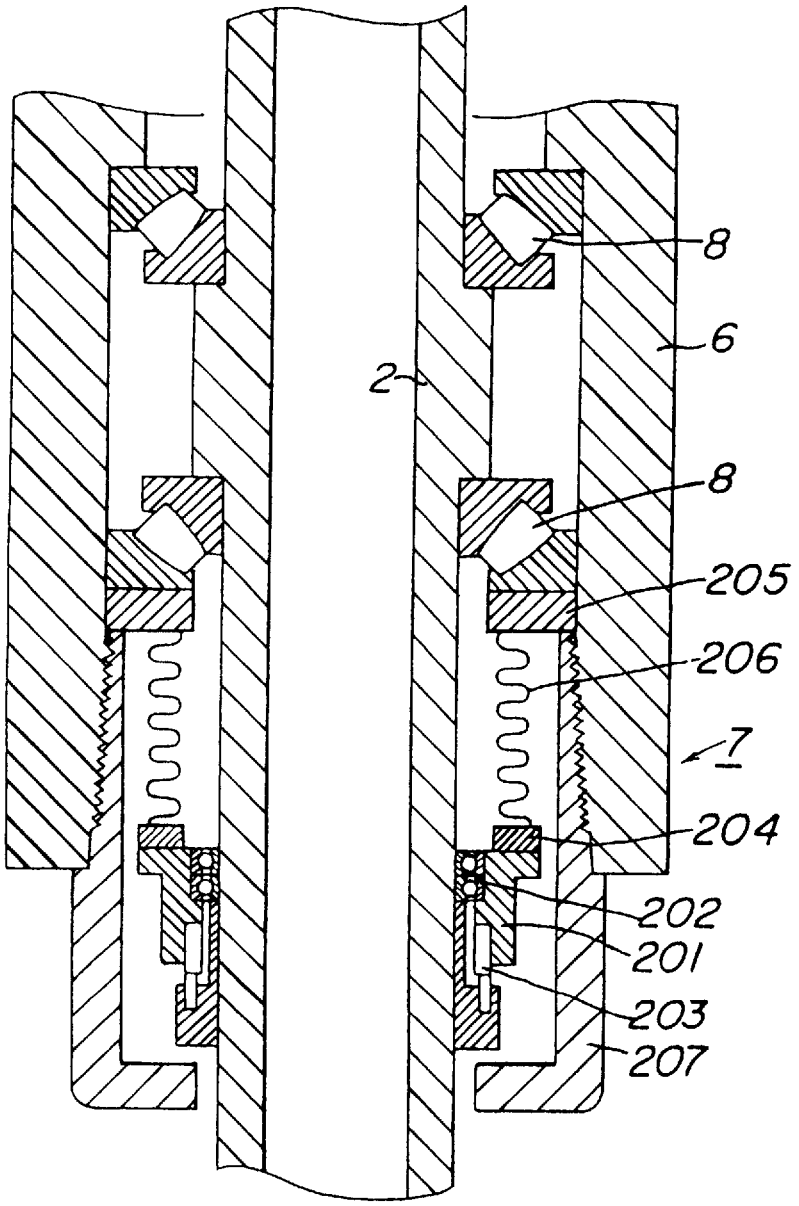
FIG. 12 is a cross sectional view of a sealing equipment located at the lower portion of the device for controlling the drilling direction of the drills according to the present invention.

In FIG. 12, there are a seal box 201, which is deposited to the lower rotating shaft 2 by a bearing 202; a mechanical seal 203, which is mounted in a ring-formed area between said seal box 201 and the lower rotating shaft 2; a bellows supporting component 204, which is mounted to the seal box 201; a bellows supporting component 205, which is provided at an inner peripheral surface below the cylinder-type housing 6; a bellows 206, which connects the bellows supporting component 204 with the bellows supporting component 205; and a protecting cover 207 for the seal box 201 and the bellows 206, through which the lower rotating shaft 2 is screw-tightened at the lower end portion of the cylinder-type housing 6.

When rotating the first and second ring-formed components 11,12 of the double eccentric mechanism portion 9 by the first and second harmonized reduction gears 13,14 and bending the lower rotating shaft 2 with respect to the cylinder-type housing 6 while keeping the fulcrum bearing 8 at its rotating center, although the seal box 201 and the mechanical seal 209 will be eccentric against the cylinder-type housing 6, the bellows 206 will deform to absorb said eccentricity, thus resulting in no adverse effect of the eccentricity upon the seal mechanism.

Moreover, the bellows 206 is structured in such a manner that the connecting portion between the cylinder-type housing 6 of the bellows supporting components 204,205 and the seal box 201 is hermetically sealed, so that the lubricant oil filled and sealed inside the device for controlling the drilling direction will not leak out.

Figure 13:
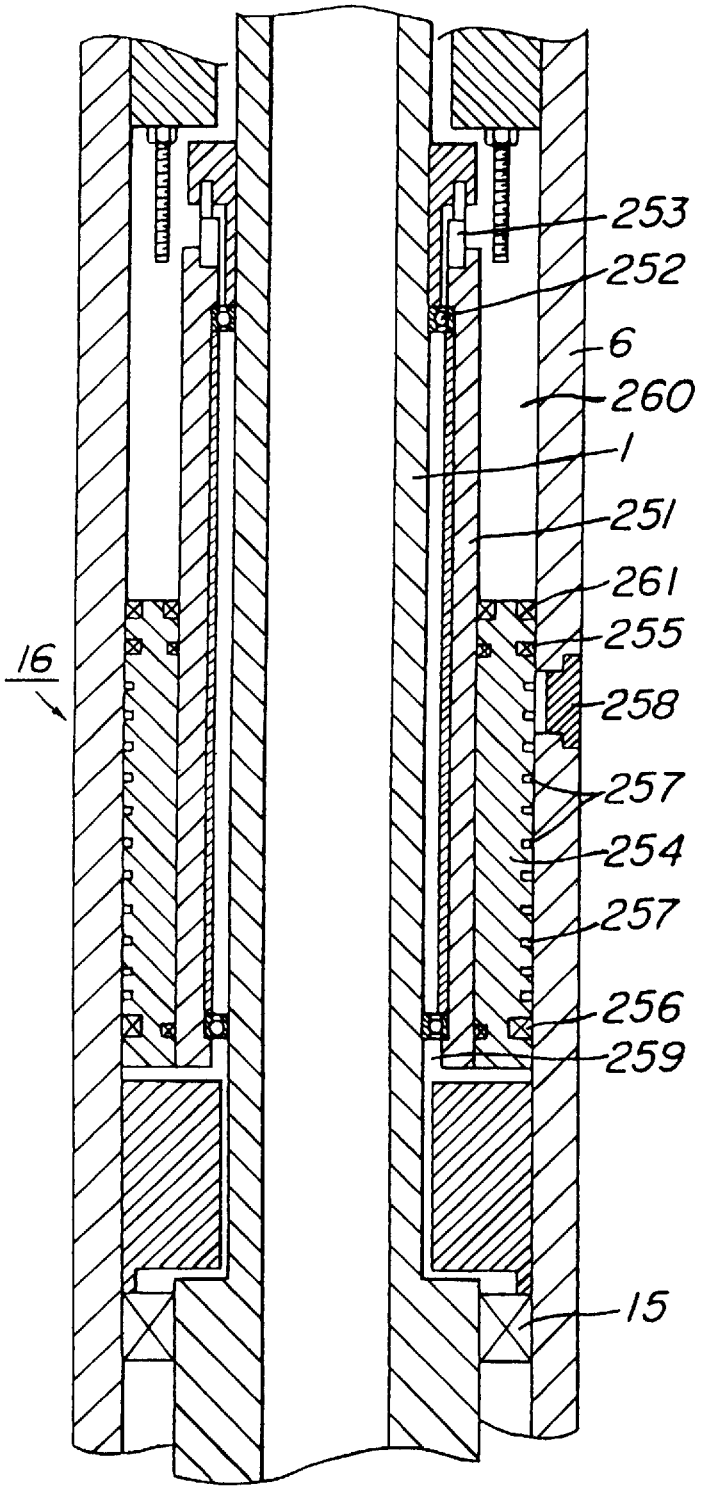
FIG. 13 is a cross sectional view of a pressure-equalizing equipment of the present invention.

FIG. 13 shows: a ring-shaped spacer 251, which embraces the upper rotating shaft 1 through a bearing 252 positioned right above the upper bearing 15; a mechanical seal 253, which is provided between said ring-formed spacer 251 and the upper rotating shaft 1; a piston 254, which has seal packings 255,256 at both sides thereof and provides slidably at a ring-shaped area formed between the ring-shaped spacer 251 and the cylinder-type housing 6 and has a slit 257, which is mounted on the outer peripheral surface at equal intervals for detecting the movement amount along the axial direction; and a window hole 258 positioned at the cylinder-type housing 6 for monitoring the slit 257. Hence the position of the piston 254 can be detected by detecting the position of the slit 257.

When the pressure of a lubricant oil 259 which has been filled and sealed inside the device for controlling the drilling direction, exceeds the pressure of a surrounding muddy water 260 due to the high temperature and pressure at the bottom area of the well conduits, the piston 254 is forced to raise up toward the muddy water side 260 until the pressure of the lubricant oil 259 becomes equal to the pressure of the muddy water 260. When the pressure of the lubricant oil 259 and the pressure of the muddy water 260 are equalized, the movement of the piston 254 will stop.

Furthermore, when the pressure of the muddy water 260 exceeds the pressure of the lubricant oil 259 which has been filled and sealed inside the device for controlling the drilling direction, the piston 254 is forced to raise up until the pressure of the muddy water 260 equalizes the pressure of the lubricant oil 259. At the moment when the pressure of the muddy water 260 and the pressure of the lubricant oil 259 are equalized, the piston movement 254 will stop. Accordingly, the device for controlling the drilling direction is structured in such a manner that the pressure of the lubricant oil 259 is well balance with the pressure of the muddy water 260.

Moreover, if the position of the piston 254 is altered by filling with lubricant oil 259 while detecting the position of the piston 254 through the window hole 258, the capacities of the piston 254 on the lubricant oil side 259 and the at the muddy water side 260 can be arbitrarily altered. The piston 254 can be set at a pre-determined position by calculating the capacities of the piston 254 at both the lubricant oil side 259 and the muddy water side 260, in correspondence to the environmental factors at the bottom area of the well conduits. In FIG. 13, there is also a packing 261 for the purpose of dust sealing.

With the aforementioned structure, the lubricant oil 259—which is filled and sealed at the ring-shaped area defined with the lower seal equipment 7 seen in FIG. 12 and the pressure-equalizing equipment 16 shown in FIG. 13—will expand and generate a high pressure due to the high temperature at the bottom of the well conduits. However, when the pressure of the lubricant oil 259 exceeds the pressure of the muddy water 260, the piston 254 is forced to rise upward toward the muddy water side 260 until the pressure of the lubricant oil 259 and the pressure of the muddy water 260 are equalized. When the pressure of the lubricant oil 259 equalizes the pressure of the muddy water 260, the movement of the piston 254 will stop.

Furthermore, when the external pressure of the muddy water 260 exceeds the pressure of the lubricant oil 259, the piston 254 is forced to rise downward toward the lubricant oil side 259 until the pressure of the muddy water 260 is equal to the pressure of the lubricant oil 259. Once the pressure of the muddy water 260 is equal to the pressure of the lubricant oil 259, the movement of the piston 254 will stop. Hence, the pressure of the lubricant oil 259 which is filled and sealed inside the device for controlling the drilling direction, is in balance with the pressure of the external muddy water 260.

As a result, the pressure of the lubricant oil 259—which is filled and sealed in the ring-shaped area defined in the lower sealing equipment 7 seen in FIG. 12 and the pressure-equalizing equipment 16 shown in FIG. 13—exhibits the nil pressure difference with the muddy water 560. Accordingly, the leaking of the lubricant oil 259 out of the lower sealing equipment 7 and the upper sealing equipment 16 will be prevented, and, at the same time, leaking of the muddy water 260 into the sealing portion of the lubricant oil 259 will also be avoided.

Moreover, when the first and second ring-formed components 11,12 of the double eccentric component 9 are rotated by the first and second harmonized reduction gears 13,14, and, as seen in FIG. 2, the lower rotating shaft 2 is bent with respect to the cylinder-type housing 6 while keeping the fulcrum bearing 8 at its rotating center, the seal box 201 and the mechanical seal 203 will be eccentric with respect to the cylinder-type housing 6. However, the eccentricity will be absorbed by the appropriate deformation of the bellows 206, so that the sealing mechanism of the mechanical seal 203 will not be jeopardized. Furthermore, the relative inclination of the lower rotating shaft 2 and the cylinder-type housing 6 can be absorbed by the bellows 206 of the lower sealing equipment 7.

Embodiment 5

A sealing equipment for the device for controlling the drilling direction for the drills, according to the present invention, will be described be referring to FIGS. 1 and 2 as well as FIGS. 14 and 15.

Figure 14:
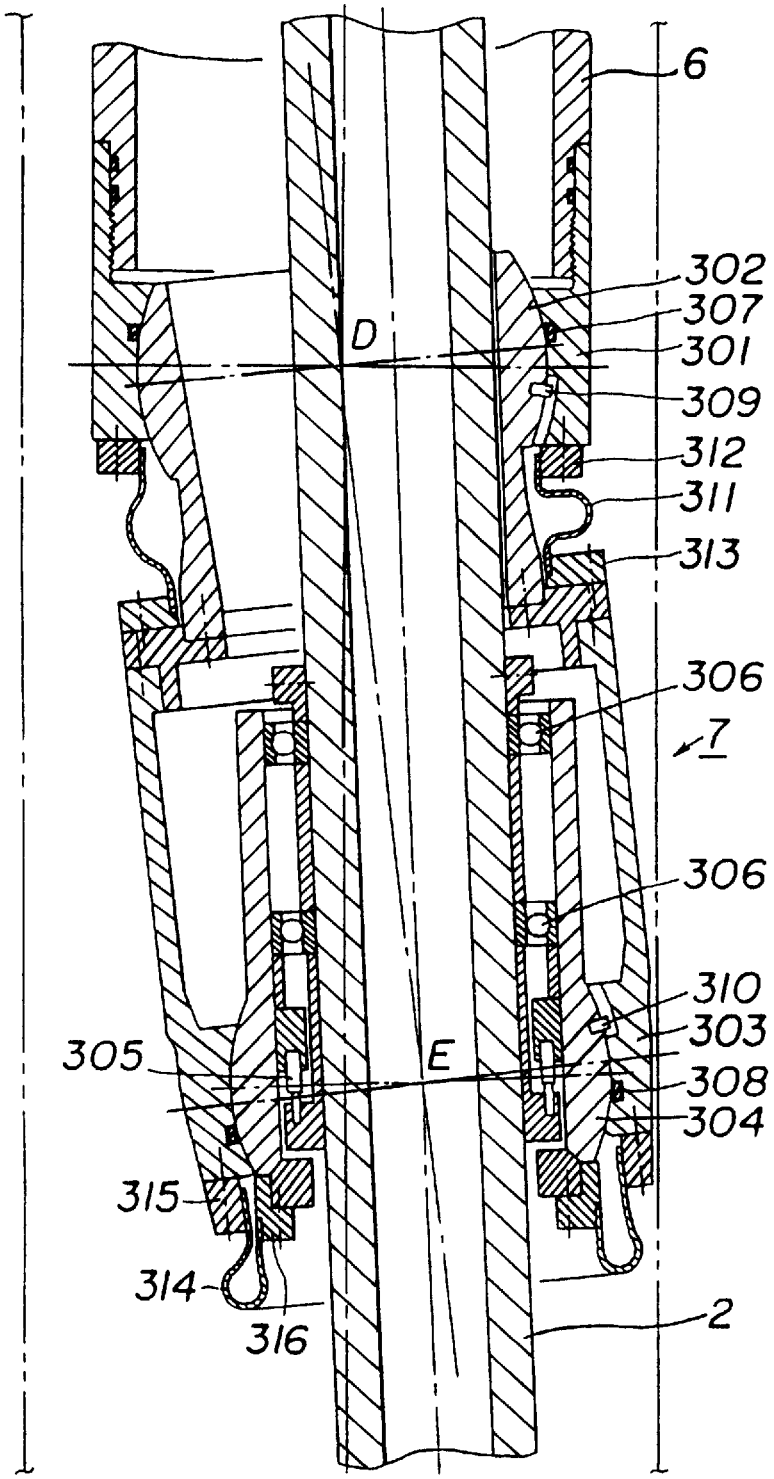
FIG. 14 is a detailed enlarged view of another portion of the lower sealing equipment of the device for controlling the drilling direction of the drills according to the present invention.

In the lower sealing equipment 7 as seen in FIG. 14, there are a first concave component 301 having a concave spherical surface portion which is connected to the cylinder-type housing 6, a first hollow convex component 302 having a convex spherical surface portion which slides along the concave spherical surface portion of the first concave component 301, a second concave component 303 having a concave spherical surface portion at its lower portion which is connected to the lower portion of the first convex component 302, and a second hollow convex component 304 having the convex spherical surface portion which slides along the concave spherical portion of the second concave component 303. The lower rotating shaft 2 is inserted rotatably at an area defined between the second convex component 304 and the lower rotating shaft 2 through a mechanical seal 305 and a ball bearing 306.

There are also, in FIG. 14, an O-ring 307 which is located on the spherical surface portions of the first concave component 301 and the first convex component 302, and an O-ring 308, which is located on the spherical surface portions of the second concave component 303 and the second convex component 304, in order to prevent the leakage of the lubricant oil.

There are still a first rotation stop pin 309 which is mounted at the spherical surface portion of the first concave component 301 and the first convex component 302, and a second rotation stop pin 310, which is located on the spherical surface portion of the second concave component 303 and the second convex component 304. With the above structure, the lower rotating shaft 2 rotates along with the first convex component 302 and the second convex component 304 between the respective spherical surface portions, so that the each spherical portions will not be damaged.

Furthermore, although all of the aforementioned components are parallel to each other when the lower rotating shaft 2 is parallel to the axial center of the cylinder-type housing 6, when the first and second ring-formed components 11,12 of the double eccentric mechanism portion 9 are forced to rotate and the lower rotating shaft 2 is bent with respect to the cylinder-type housing 6, the center B of the second spherical component moves in an arc with a rotating radius of the distance between the center D of the first spherical component and the center E of the second spherical component thus keeping the center D as its rotating center. At this moment, the second convex component 304, the lower rotating shaft 2 and the mechanical seal 305 are kept parallel to each other, so that the sealing mechanism of the mechanical seal 305 will not be jeopardized.

In FIG. 14, there are also a ring-formed expansion component 311 which is welded at its both ends to a fixing component 312 of the first concave component 301 and a fixing component 313 at the upper end portion of the second concave component 303, respectively, and a ring-formed expansion component 314 which is welded at its both ends to a fixing component 315 at the lower end portion of the second concave component 303 and a fixing component 316 of the second convex component 304, so that the leakage of the muddy water into the first and second spherical surface portions can be prevented.

Figure 15:
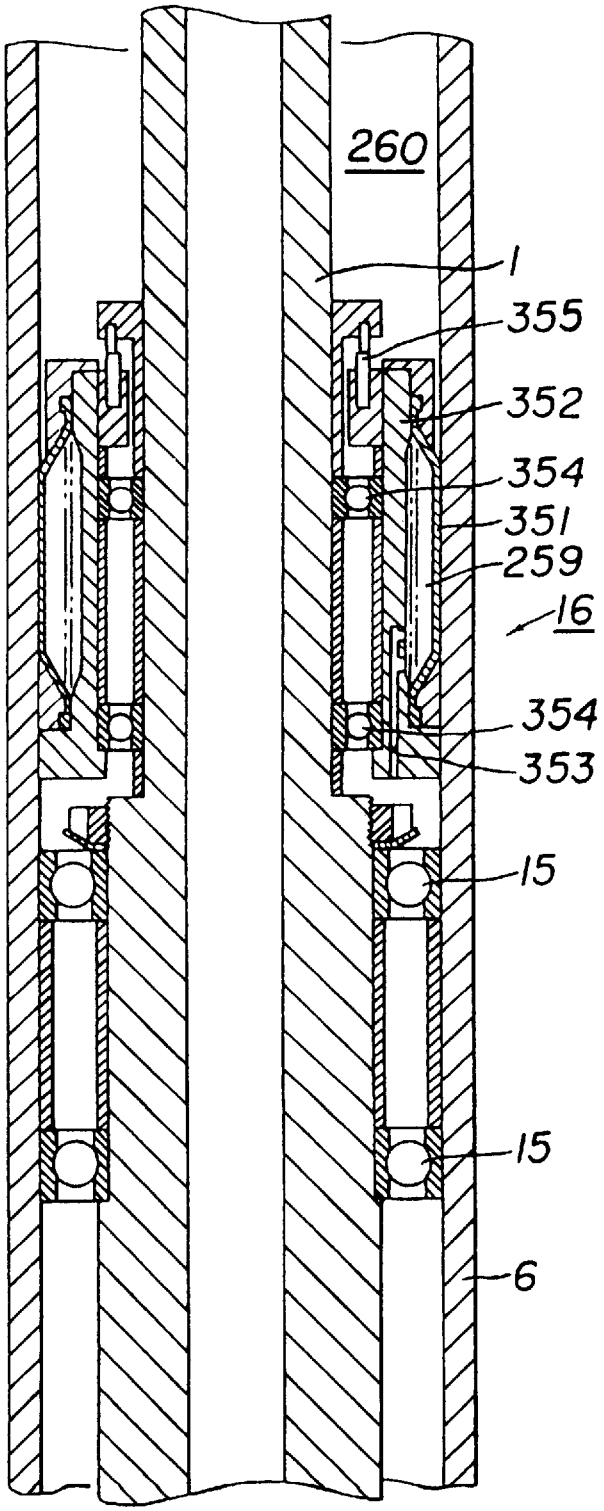
FIG. 15 is a detailed enlarged view of another portion of the upper sealing equipment of the device for controlling the drilling direction of the drills according to the present invention.
Figure 16:
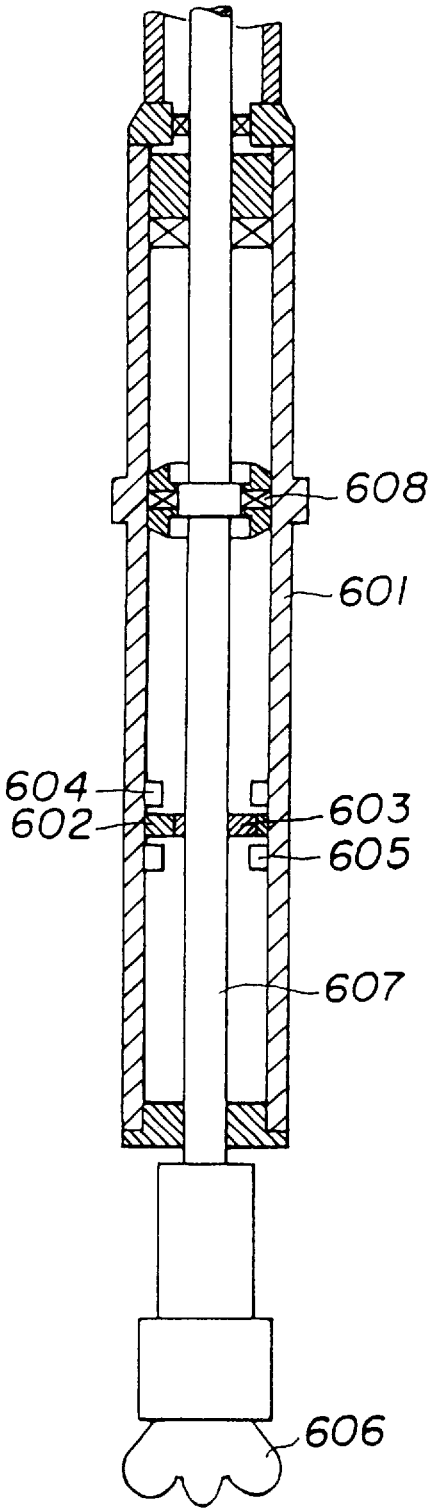
FIG. 16 is a general view of the device for controlling the drilling direction of the oil well drills, disclosed in Japan Patent Application Laid-Open No. Hei 5-202689.
Figure 17A:
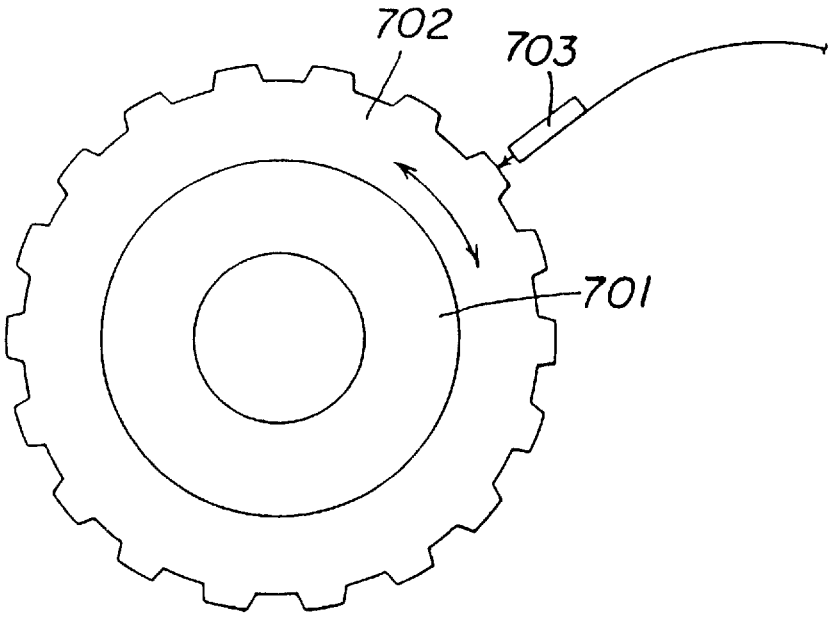
FIG. 17 shows a conventional pulse-counting method with which the angle detecting mechanism is formed with a sending/receiving one-unit type, wherein (a) explains the principle of the angle detection and (b) is the detected pulses.
Figure 17B:
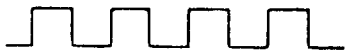

In the upper sealing equipment 16 seen in FIG. 15, there is a bladder 351 made of an elastic material such as a rubber. Said bladder is stored in a bladder case 352, which is secured to an inner peripheral surface of the cylinder-type housing 6, so that the lubricant oil 259 (which has been filled and sealed inside the device for controlling the drilling direction) flows in and out the bladder 351 through a connecting hole 353, which is deposited at the bearing side 15 at the lower portion of the bladder case 352. The outer surface of said sealing equipment is in contact with the muddy water 260. There are also a ball bearing 354 which is provided at an area defined between the inner peripheral surface of the bladder case 352 and the upper rotating shaft 1, and a mechanical seal 355, which is assembled in the spherical area formed between the bladder case 352 at the upper portion of the ball bearing 354 and the upper rotating shaft 1, so that the spherical area portion between the bladder case 352 and the upper rotating shaft 1 can be sealed.

When the pressure of the lubricant oil 259, which has been filled and sealed inside the device for controlling the drilling direction, exceeds the pressure of the muddy water 260 due to the high temperature in the bottom area of the well conduit, the lubricant oil 259 flows into the bladder 351 through the connecting hole 353. As a result, the bladder 351 expands gradually outward from the cylinder-form, and the expansion of the bladder 351 due to the flowing-in of the lubricant oil 259 will stop where the pressure therebetween is equalized.

When the pressure of the muddy water 260 exceeds the pressure of the lubricant oil 259, which has been filled and sealed in the device for controlling the drilling direction, the lubricant oil 259 flows out from inside the bladder 351 through the connecting hole 353, the bladder 351 shrinks from its expanded condition, and the shrinkage due to the flowing-out of the lubricant oil 259 will stop when the pressure therebetween is equalized. Hence, the pressure of the lubricant oil 259, which has been filled and sealed in the device for controlling the drilling direction, and the pressure of the muddy water 260 will be well balance with respect to each other.

With the aforementioned structure, the lubricant oil 259 which is filled and sealed at ground level in the spherical area portion defined between the lower sealing equipment 7 as seen in FIG. 14 and the upper sealing equipment 16 as seen in FIG. 15, will be subjected to an expansion and high pressure due to the high temperature realized at the bottom area of the well conduit. However, when the pressure of the lubricant oil 259 exceeds the pressure of the muddy water 260, the lubricant oil will flow into the bladder 351 through the connecting hole 353. Moreover, the bladder 351 expands gradually outwardly from its cylinder-form, and the expansion due to the flowing-in will stop at the moment when the pressure therebetween is equalized.

Moreover, when the pressure of the muddy water 260 exceeds the pressure of the lubricant oil 259, which has been filled and sealed in the spherical area portion, the lubricant oil will flow out from inside the bladder 351 to the spherical area portion through the connecting hole 353, and the shrinkage of the bladder 351 due to the flowing-out will stop when the pressure of the lubricant oil 259 becomes to equal to the pressure of the external muddy water 260.

As a result, the pressure of the lubricant oil 259 which has been filled and sealed at ground level in the spherical area portion defined between the lower sealing equipment 7 as seen in FIG. 14 and the upper sealing equipment 16 as seen in FIG. 15, will exhibit nil pressure difference with the external muddy water 260. Accordingly, the leakage of the lubricant oil 259 out of the lower sealing equipment 7 and the upper sealing equipment 16 can be prevented, and the leaking-in of the muddy water 260 into the sealing portion of the lubricant oil 259 can also be avoided.

Furthermore, by rotating the first and second ring-formed components 11,12 of the double eccentric mechanism 9 using the first and second harmonized reduction gears 13,14 and, as seen in FIG. 2, by bending the lower rotating shaft 2 around the cylinder-type housing 6, the center E of the second spherical surface portion at the lower sealing equipment 7, as seen in FIG. 14, will move along with the lower rotating shaft 2 in a circular arc with a rotating radius of the distance between the center D of the first spherical component and the center E of the second spherical component thus keeping the center D as the rotation center of the first spherical component, as illustrated in FIG. 14. At this moment, the convex component 304, lower rotating shaft 2 and the mechanical seal 305 are all in parallel to each other, so that the sealing function of the mechanical seal 305 will not be jeopardized. Moreover, the stress generated by the relative inclination realized between the lower rotating shaft 2 and the cylinder-type housing 6 can be absorbed by the first and second spherical portions of the lower sealing equipment 7.

Embodiment 6

The detailed description of the other type of the device for controlling the drilling direction will be explained by referring to FIGS. 1 and 2 as well as FIGS. 12 and 15.

In FIG. 12, there are a seal box 201, which is mounted on the lower rotating shaft 2 through the bearing 202; a mechanical seal 203, which is assembled to the ring-shaped area portion defined between the seal box 201 and the lower rotating shaft 2; a bellows supporting component 204, which is deposited to said seal box 201; a bellows supporting component 205, which is provided on the inner peripheral surface of the lower portion of the cylinder-type housing 6; a bellows 206 connecting the bellows supporting component 204 and the bellows supporting component 205; and a protection cover 207 for the bellows 206 and the seal box 201, through which the lower rotating shaft 2 is screw-engaged at the lower portion of the cylinder-type housing 6.

Rotating the first and second ring-formed components 11,12 of the double eccentric mechanism portion 9 by operating the first and second harmonized reduction gears 13,14 and by bending the lower rotating shaft 2 while keeping the fulcrum bearing 8 as its rotating center with respect to the cylinder-type housing 6, the seal box 201 and the mechanical seal 203 will be eccentric with respect to the cylinder-type housing 6. However, the bellows 206 will deform itself to absorb the amount of the above said eccentricity, so that the sealing mechanism will not be jeopardized.

Moreover, the bellows 206 is structured in such a manner that since the portion connecting the cylinder-type housing 6 of the bellows supporting components 204,205 and the seal box 201 is hermetically sealed, then the lubricant oil, which has been filled and sealed inside the device for controlling the drilling direction, will not leak externally.

In the upper seal equipment 16 shown in FIG. 15, there is a bladder 351 made of an elastic material such as a rubber which is stored inside the bladder case 352 and is secured to an inner peripheral surface of the cylinder-type housing 6. The lubricant oil 259, which has been filled and sealed inside the device for controlling the drilling direction, flows in and out of the inside of the bladder 351 through the connecting hole 353, which is provided on the bearing side 15 at lower portion of the bladder case 352, and the outer peripheral surface is in contact with the external muddy water 260. There are also a ball bearing 354, which is located in an area defined between the inner peripheral surface of the bladder case 352 and the upper rotating shaft 1. and a mechanical seal 355, which is assembled at the ring-shaped area portion being defined between the bladder case 352 at upper portion of the ball bearing 354 and the upper rotating shaft 1, so that the ring-shaped area potion between the bladder case 352 and the upper rotating shaft 1 will be tightly sealed.

When the pressure of the lubricant oil 259, which has been filled and sealed in the device for controlling the drilling direction, exceeds the pressure of the muddy water 260 due to the high temperature at the bottom portion of the well conduit, the lubricant oil 259 will flow into the bladder 351 through the connecting hole 353, the bladder 351 will expand gradually outward from its cylinder-form condition, and the expansion due to the flowing-in of the lubricant oil 259 will stop at the moment when the pressure therebetween is equalized.

Moreover, when the pressure of the muddy water 260 exceeds the pressure of the lubricant oil 259, which has been filled and sealed in the device for controlling the drilling direction, the lubricant oil 259 will flow out from inside the bladder 351 through the connecting hole 353, and the bladder 351 will shrink from its expanded condition until the moment when the pressure of the internal lubricant oil and the pressure of the external muddy water become equal. Hence the pressure of the lubricant oil and the pressure of the muddy water will be well balanced.

In the above-mentioned structure, the lubricant oil 259 (which has been filled and sealed in the ring-shaped area portion defined between the lower seal equipment 7 at seen in FIG. 12 and the upper seal equipment 16 as seen in FIG. 15) will expand and generate a high pressure due to the high temperature realized at the bottom area of the well conduit. However, when the pressure of the lubricant oil becomes higher than the pressure of the muddy water 260, the lubricant oil 259 will flow into the inside of the bladder 351 through the connecting hole 353. Furthermore, the bladder 351 will expand gradually externally from its cylinder-form condition, and the expansion due to the flowing-in will stop at the moment when the pressure of the lubricant oil and the pressure of the muddy water are in balance to each other.

When the pressure of the external muddy water 260 becomes higher than the pressure of the lubricant oil 259, the lubricant oil 259, which has been filled and sealed in the spherical area portion, flows out from the bladder 351 to the ring-shaped area portion through the connecting hole 353. When the pressure of internal lubricant oil 259 becomes equal to the pressure of the external muddy water 260, the shrinkage of the bladder 351 due to the flowing-out will stop.

Namely, the pressure of the lubricant oil 259, which is filled and sealed at ground level in the spherical area portion defined between the lower seal equipment 7 as seen in FIG. 12 and the upper seal equipment 16 as seen in FIG. 15, always exhibits nil pressure difference with the external muddy water 260. As a result, the leakage of the lubricant oil 259 from the lower seal equipment 7 and the upper seal equipment 16 can be prevented, and, at the same time, the leakage of the muddy water 260 into the sealed portion of the lubricant oil 259 can be also avoided.

Furthermore, when the first and second ring-formed components 11,12 of the double eccentric mechanism portion 9 are forced to rotate by operating the first and second harmonized reduction gears 13,14, and the lower rotating shaft 2, while keeping the fulcrum bearing 8 as its rotating center, is bent with respect to the cylinder-type housing 6, as seen in FIG. 2, then the seal box 201 and the mechanical seal 203 will be eccentric with respect to the cylinder-type housing 6. However, the eccentricity will be absorbed by the deformation of the bellows 206, so that the sealing function of the mechanical seal 203 will not be jeopardized. Moreover, the relative inclination defined between the lower rotating shaft 2 and the cylinder-type housing 6 can also be absorbed by the bellows 206 of the lower seal equipment 7.

Industrial Applicability

In the device for controlling the drilling direction according to the present invention, by employing a resolver in order to detect the eccentric angle at the double eccentric mechanism portion, the absolute magnitude of the rotating angle of two ring-formed components can be detected with a great accuracy, and accurate and stable control of the drilling direction can be achieved in a step-less control manner. Moreover, by locating the fulcrum bearing at a midpoint defined between the double eccentric mechanism portion and the drill bit, it is possible to locate the lower seal portion close to, the fulcrum bearing, so that the magnitude of the displacement of the rotating angle of the rotating shaft at the lower seal portion can be small and the seal structure can be designed and manufactured with a simpler structure. Furthermore, since the bit load can be received at the fulcrum bearing and transferred to the cylinder-type housing, the bit load is not directly acting on the double eccentric mechanism portion from the rotating shaft; hence that the relatively weak structure of the double eccentric mechanism portion from the standpoint of the mechanical strength can be protected. Moreover, since the fulcrum bearing is located close enough to the lower seal portion, not only can a larger inclination angle of the rotating shaft be made at the lower seal portion, but a larger diameter of the rotating shaft can also be designed and manufactured. Furthermore, by depositing the flexible joint at the upper portion of the double eccentric mechanism portion, the deflection of the rotating shaft due to the flexible joint can be prevented, and the occurrence of excessive bending stress can also be avoided.

Moreover, since the hollow universal joint for the drills of the present invention can also prevent the leaking-out of the fluid flowing inside the hollow portions of the rotating shaft for the drills, if said hollow universal joint is installed at the position, where the maximum bending stress might possibly take place. Thus the bending stress on the rotating shaft can be greatly reduced, so that the fatigue life of the rotating shaft can be tremendously improved.

Furthermore, by employing the pressure-equalizing equipment for controlling the drilling direction of the present invention, even if the lower rotating shaft is inclined in order to change the drilling direction, the sealing mechanism of the lower sealing equipment, located between the lower rotating shaft and the cylinder-type housing, is not jeopardized. Besides, the relative inclination can be absorbed at the bellows of the lower sealing equipment, and the pressure of the lubricant oil, which has been filled and sealed in the ring-shaped area portion of the device for controlling the drilling direction, can be equalized with the pressure of the external muddy water by the piston. As a result, the leaking-out of the lubricant oil from the lower sealing equipment and the pressure-equalizing equipment can not only be prevented, but the leaking-in of the muddy water into the sealing portion of the lubricant oil can also be avoided. Accordingly, any conceivable damage on the device for controlling the drilling direction can be avoided.

By using the sealing equipment for the device for controlling the drilling direction of the present invention, even if the lower rotating shaft is inclined in order to change the drilling direction, the sealing function of the lower sealing equipment, which is located between the lower rotating shaft and the cylinder-type housing, is not jeopardized. Moreover, the relative inclination can be absorbed at two spherical surface portions of the lower sealing equipment. Besides, the pressure of the lubricant oil (which has been filled and sealed in the ring-formed area portion including the device for controlling the drilling direction) can be equalized with the pressure of the muddy water through the bladder of the upper sealing equipment. As a result, the leaking-out of the lubricant oil from both the lower sealing equipment and the upper sealing equipment can not only be prevented, but the leakage of the external muddy water into the sealing portion of the lubricant oil can also be avoided. Therefore, any possible damages to the device for controlling the drilling direction can be prevented.

By utilizing the sealing equipment of the device for controlling the drilling direction of the present invention, even if the lower rotating shaft is inclined in order to alter the drilling direction, the sealing function of the lower sealing equipment located between the lower rotating shaft and the cylinder-type housing will not be jeopardized. Moreover, the relative inclination can be absorbed by the bellows at the lower sealing equipment and the pressure of the lubricant oil being filled and sealed in the spherical area portion of the device for controlling the drilling direction can be equalized with the pressure of the muddy water by employing the bladder of the upper sealing equipment. As a result, the leaking-out of the lubricant oil from both the lower sealing equipment and the upper sealing equipment can be prevented. At the same time, the leakage of the external muddy water into the sealing portion of the lubricant oil can also be avoided, so that any damages to the device for controlling the drilling direction can be prevented.

Furthermore, in the angle detecting equipment to be used for the device for controlling the drilling direction of the present invention, a low frequency signal is utilized by employing the resolver of the hollow rotator in order to detect the eccentric angle at the double eccentric mechanism portion, so that there would not be any attenuation or noises involved even if the cable length is increased. As a result, stable and accurate detection of the absolute value of the angle of the original reference angle position, which is set in two ring-formed components, is achieved. Moreover, accurate controlling of the drilling direction is achieved in a step-less mode. Furthermore, one sensor of the resolver can function as an original reference point detector as well as an angle detector.

The present invention, therefore, is well adapted to carry out the objects and attain the ends and advantages mentioned as well as other inherent therein. While the presently preferred embodiments of the invention have been given for the purposes of disclosure, numerous modifications and changes in the details of construction will be readily apparent to those skilled in the art and which are encompassed within the spirit of the invention and the scope of the appended claims.

We claim:

1. A device for controlling the drilling direction for drills comprising:

a cylinder-type housing;

upper and lower sealing devices disposed respectively on upper and lower end sides of said cylinder-type housing;

a first ring-formed component which is rotatably supported on a circular inner peripheral surface of said cylinder-type housing and has a circular inner peripheral surface that is eccentric with respect to said cylinder-type housing;

a second ring-formed component which is rotatably supported on the circular inner peripheral surface of the first ring-formed component and has a circular inner peripheral surface that is eccentric with respect to said circular inner peripheral surface; and a hollow harmonized reduction gear which rotates relative to the first and second ring-formed components around the centers of said components;

said controlling device is structured in such a way that the magnitude of eccentricity of the circular inner peripheral surface of the first ring-formed component with respect to the cylinder-type housing is equal to the magnitude of eccentricity of the circular inner peripheral surface of the second ring-formed component with respect to the first ring-formed component, a rotating shaft of the drills is connected to the second ring-formed component in order to move it along with the center of the circular inner peripheral surface of the second ring-formed component as a single body, and the first and second ring-formed components rotate individually to perform a position-detection of said rotating shaft;

said controlling device further comprising:

a rotating angle-detecting device disposed between said first and second ring-formed components and a hollow harmonized reduction gear to detect the rotating angle of the first and second ring-formed components;

a fulcrum bearing of the rotating shaft interposed between a drill bit and a double eccentric mechanism consisting of said first and second ring-formed components;

a flexible joint disposed above said double eccentric joint to be interposed between said double eccentric mechanism and an upper bearing, said flexible joint absorbing a displacement in the direction perpendicular to the axis of the rotating shaft; and said lower sealing device disposed adjacent to said fulcrum bearing.

2. The device for controlling the drilling direction of the drill as claimed in claim 1, wherein said flexible joint comprises a hollow-type universal joint for drilling, the universal joint being formed with an upper rotating shaft having a lower end connected to a first hollow yoke, a hollow center shaft, a lower rotating shaft having an upper end connected to a second hollow yoke, and a first and second cross-pins, each having a through-hole and a seal-tube inserted in said through-hole, the first cross-pin of which connecting in water-tight between said upper rotating shaft and said hollow center shaft and the second cross-pin of which connecting in water-tight said hollow center shaft and said lower rotating shaft.

3. The device for controlling the drilling direction of the drill as claimed in claim 1, wherein said upper sealing device comprises an annular spacer fitted around the upper rotating shaft through a bearing; a sealing means interposed between said annular spacer and said upper rotating shaft, and a piston provided at its both ends with packing seals and on its outer peripheral surface with a plurality of equidistantly spaced slits for detecting the degree of axial movement, said piston being recipricated in an annular slit formed between said annular spacer and the cylinder-type housing by difference of a hydraulic pressure between a lubricant enclosed in the drilling direction controlling device and muddy water deposited above the piston.

4. The device for controlling the drilling direction of the drill as claimed in claim 1, wherein said upper sealing device comprises a bladder case disposed near the upper bearing in the upper sealing device and attached to the inner peripheral surface of the cylinder-type housing through ball bearings, a mechanical seal means and a bladder housed in said bladder case and provided in its inside with a flow passage of a lubricant oil enclosed in the drilling direction controlling device, the outside surface of said bladder being in contact with sewage.

5. The device for controlling the drilling direction of the drill as claimed in claim 1, wherein said lower sealing device comprises a pair of first hollow spherical members connected to the lower part of the cylinder-type housing, a pair of second hollow spherical members located under said first hollow spherical members, each of said first and second paired hollow spherical members being provided on the boundary surface of the spherical members with an O-ring and a pin for preventing rotation of the spherical members in the direction perpendicular to the axis of these members, and a mechanical seal disposed in an annular recess formed between the second paired hollow spherical members and the rotating shaft.

6. The device for controlling the drilling direction of the drill as claimed in claim 1, wherein said lower sealing device comprises a seal box fitted to the rotating shaft through bearings, a seal mechanism interposed between said seal box and the rotating shaft, and a bellows connecting said seal box with the lower part of the cylinder-type housing.

* * * * *